US008552653B2

(12) United States Patent
Kitazawa et al.

(10) Patent No.: US 8,552,653 B2
(45) Date of Patent: Oct. 8, 2013

(54) ELECTRO-OPTICAL DEVICE, ELECTRONIC APPARATUS, AND METHOD OF DRIVING ELECTRO-OPTICAL DEVICE

(75) Inventors: Takayuki Kitazawa, Suwa (JP); Takehiko Kubota, Matsumoto (JP); Toshiyuki Kasai, Okaya (JP)

(73) Assignee: Seiko Epson Corporation, Tokyo (JP)

( * ) Notice: Subject to any disclaimer, the term of this patent is extended or adjusted under 35 U.S.C. 154(b) by 165 days.

(21) Appl. No.: 13/295,565

(22) Filed: Nov. 14, 2011

(65) Prior Publication Data

US 2012/0119667 A1 May 17, 2012

(30) Foreign Application Priority Data

Nov. 17, 2010 (JP) ..... 2010-256551
Mar. 16, 2011 (JP) ..... 2011-057668

(51) Int. Cl.
*G09G 3/10* (2006.01)

(52) U.S. Cl.
USPC ..... 315/169.3; 315/167; 315/169.1; 345/76; 345/77; 345/204

(58) Field of Classification Search
USPC ..... 315/167, 169.1–169.4; 345/76–77, 345/82–83, 90–92, 204
See application file for complete search history.

(56) References Cited

U.S. PATENT DOCUMENTS

2008/0030436 A1* 2/2008 Iida et al. ..... 345/77
2010/0039411 A1* 2/2010 Yatabe et al. ..... 345/204
2010/0045637 A1 2/2010 Yamashita et al.

FOREIGN PATENT DOCUMENTS

JP A-2008-304690 12/2008
JP A-2010-048864 3/2010

* cited by examiner

*Primary Examiner* — Anh Tran
(74) *Attorney, Agent, or Firm* — Oliff & Berridge, PLC

(57) ABSTRACT

An electro-optical device includes a first pixel circuit which is disposed so as to correspond to each intersection between a scanning line and a first data line, a second pixel circuit which is disposed so as to correspond to each intersection between a scanning line and a second data line, a signal line, a selection section, a driving circuit. In a first selection period, the selection section is operated such that the first data line and the second data line are electrically connected to the signal line. In the second selection period, the selection section is operated such that the second data line is electrically connected to the signal line. In a writing period, the first data potential is supplied to the first pixel circuit and the second data potential is supplied to the second pixel circuit.

14 Claims, 17 Drawing Sheets

(a) INITIALIZATION PERIOD

ELECTRO-OPTICAL DEVICE, ELECTRONIC APPARATUS, AND METHOD OF DRIVING ELECTRO-OPTICAL DEVICE

BACKGROUND

1. Technical Field

The present invention relates to an electro-optical device and an electronic apparatus.

2. Related Art

In recent years, there have been proposed various electro-optical devices using an electro-optical element such as an organic light emitting diode (hereinafter, referred to as an "OLED") called an organic EL (Electro-Luminescent) element or a light emitting polymer element. As one of types of driving the electro-optical device, a multiplexer type is known (for example, refer to JP-A-2008-304690). In JP-A-2008-304690, a plurality of data lines is sorted as a plurality of blocks each having three data lines, and a plurality of image signal lines respectively corresponding to the data lines constituting the block is provided. In one horizontal scanning period, signal voltages of R, G, and B are sequentially supplied from the image signal line corresponding to the block to each of three data lines included in each block.

Each pixel of JP-A-2008-304690 includes a light emitting element emitting light with luminance in accordance with a driving current, a driving transistor controlling the driving current, and a selection transistor disposed between the driving transistor and the data line and controlled to be turned on or off in accordance with a signal supplied to the scanning line. In JP-A-2008-304690, for a predetermined period before a signal writing period as a period within one horizontal scanning period, the selection transistor of the pixel circuit corresponding to the scanning line to be selected in the one horizontal scanning period is set to an off state, and signal voltages VsigR, VsigG, and VsigB of R, G, and B are distributed to the respective data lines. The signal voltage supplied to each data line is held by a parasitic capacitance or the like present in the data line. Then, in the subsequent signal writing period, the selection transistors of the pixel circuits corresponding to the scanning line to be selected in the one horizontal scanning period are set to an on state in a batch, so that the signal voltages held in the respective data lines are written to the pixels in a batch.

Incidentally, a parasitic capacitance is present between the adjacent data lines, so that capacitive coupling is performed therebetween. Now, a case is assumed in which a signal voltage is supplied to a first data line in a certain block and a signal voltage is supplied to a second data line adjacent thereto. Since the first data line is in an electrical floating state when supplying the signal voltage to the second data line, the potential of the first data line changes while being synchronized with the potential of the second data line. At this time, the potential of the first data line changes from the precedent potential (the signal voltage value written to the first data line) by a value corresponding to a change amount of the potential of the second data line.

Next, a case is assumed in which a signal voltage is supplied to a second data line and a signal voltage is supplied to a third data line. Since the second data line is in an electrical floating state when supplying the signal voltage to the third data line, the potential of the second data line changes while being synchronized with the potential of the third data line. At this time, the potential of the second data line changes from the precedent potential (the signal voltage value written to the second data line) by a value corresponding to a change amount of the potential of the third data line. As described above, there is a problem in that the value of the signal voltage written to each data line is deviated from a desired value due to the signal voltage written to the data line adjacent to the corresponding data line.

SUMMARY

An advantage of some aspect of the invention is to suppress a signal value written to each data line from being deviated from a desired value.

In order to solve the above-described problems, according to an aspect, there is provided an electro-optical device (100) including: a plurality of pixel circuits (U) each of which is disposed so as to correspond to each intersection between a plurality of scanning lines (120) and a plurality of data lines (16) sorted as a plurality of blocks (B) each having data lines; a plurality of signal lines (18) each of which corresponds one-to-one to the plurality of blocks; a plurality of selection sections (MP) each of which is provided so as to correspond one-to-one to each of the plurality of blocks and which switches a connection and disconnection state between each data line included in the corresponding block and the signal line corresponding to the block; and a driving circuit (20) that drives the plurality of pixel circuits at a cycle of a unit period (one horizontal scanning period H), wherein each of the plurality of pixel circuits includes: a selection transistor (TSL) that writes a data potential of the data line as an on state in the pixel circuit, and a light emitting element (E) that emits light with luminance in accordance with the written data potential, wherein the unit period includes a plurality of selection periods (Ts) and a writing period (PWR) after the plurality of selection periods, wherein the driving circuit is operated in the plurality of selection periods such that the data potential (DT) in accordance with the luminance (D) of the light emitting element of the pixel circuit corresponding to each intersection between the scanning line to be selected in the unit period and each data line included in the block corresponding to the signal line is sequentially output to each signal line and each selection transistor of the plurality of pixel circuits corresponding to the scanning line to be selected in the unit period is set to an off state, wherein the driving circuit is operated in the writing period such that the respective selection transistors of the plurality of pixel circuits corresponding to the scanning line to be selected in the unit period are set to an on state in a batch, and wherein each of the plurality of selection sections is operated in each of the plurality of selection periods such that the data line corresponding to the pixel circuit to be used to supply the data potential output to the signal line corresponding to the selection section in the corresponding selection period and the data line corresponding to the pixel circuit to be used to supply the data potential output to the signal line in the selection period after the corresponding section period are selected to be electrically connected to the signal line.

According to the aspect, the data potential (referred to as a "second data potential") output to the signal line in a second selection period is written to the data line corresponding to the pixel circuit to be used to supply the data potential output to the signal line in the selection period after the second selection period in the plurality of data lines within the block in a selection period (referred to as the "second selection period") immediately before a selection period (referred to as a "first selection period") during which the data potential (referred to as a "first data potential") to be supplied to the pixel circuit corresponding to the data line is written to the data line. That is, since the potential of the data line immediately before the first selection period is set to the second data potential, the change amount of the potential of the data line in the first selection period becomes |first data potential-second data potential|. Therefore, the change amount of the potential of the data line in the first selection period is suppressed compared to an aspect (referred to as a "comparative example") in which the potential of the data line immediately before the first selection period is set to an initialization potential sufficiently lower than the data potential. Accordingly, it is possible to suppress the change amount (the change amount due to capacitive coupling) of the potential of the different data line generated with the writing of the first data potential to the data line compared to the comparative example. That is, there is an advantage in that the data potential written to each data line may be suppressed from being deviated from a desired value.

In the electro-optical device according to the aspect, each pixel circuit may include: a driving transistor (TDR) that is connected in series to the light emitting element in a path between a high potential side power supply line (41) and a low potential side power supply line (45), a first capacitance element (C1) that is interposed between a gate and a source of the driving transistor, and a current generating section (C2 and 14) that generates a set current (Is) flowing to a path branched from a path reaching the light emitting element from the high potential side power supply line via the driving transistor and a node (ND) interposed between the driving transistor and the light emitting element, and the driving circuit may be operated in the plurality of selection periods and the writing period such that the voltage across ends of the first capacitance element at the end point of the writing period is set to a value reflecting a characteristic of the driving transistor by controlling the current generating section so that the set current flows to each of the driving transistors of the plurality of pixel circuits corresponding to the scanning line to be selected in the unit period. In this aspect, the driving circuit performs a mobility compensation operation of each driving transistor through the plurality of selection periods and the writing period within the unit period (one horizontal scanning period) by controlling the current generating section so that the set current flows to each driving transistor of the plurality of pixel circuits corresponding to the scanning line to be selected in the unit period in the plurality of selection periods and the writing period. That is, according to this aspect, there is an advantage in that the mobility compensation period within one horizontal scanning period may be sufficiently ensured compared to the case where the mobility compensation operation is not performed in the plurality of selection periods.

In the electro-optical device according to the aspect, the unit period may include a set period (PS) before the plurality of selection periods, and the driving circuit may be operated in the set period such that the potential of the gate of the driving transistor is set to an initialization potential by setting the potential of each data line to the initialization potential (VINI) and setting the respective selection transistors of the plurality of pixel circuits corresponding to the scanning line to be selected in the unit period to an on state in a batch, and the voltage across both terminals of the first capacitance element is set to a value necessary for causing the set current to flow to the driving transistor by controlling the current generating section so that a predetermined magnitude of the set current flows to the driving transistor.

In order to solve the above-described problems, according to an aspect, there is provided an electro-optical device comprising: a first pixel circuit which is disposed so as to correspond to each intersection between a scanning line and a first data line; a second pixel circuit which is disposed so as to correspond to each intersection between a scanning line and a second data line; a signal line; a selection section that controls a connection state between the signal line and the first data line, the selection section controlling a connection state between the signal line and the first data line; a driving circuit that drives the first pixel circuit and a second pixel circuit, wherein the first pixel circuit includes: a first selection transistor that writes a first data potential of the first data line to the first pixel circuit, and a first light emitting element that emits light with luminance in accordance with the first data potential, wherein the second pixel circuit includes: a second selection transistor that writes a second data potential of the second data line to the second pixel circuit, and a second light emitting element that emits light with luminance in accordance with the second data potential, wherein the driving circuit is operated in a first selection period such that the first data potential is output to the signal line and the first selection transistor and the second selection transistor is set to an off state, wherein the driving circuit is operated in a second selection period such that the second data potential is output to the signal line and the first selection transistor and the second selection transistor is set to an off state, wherein the driving circuit is operated in a writing period after the first selection period and the second selection period such that the first selection transistor and the second selection transistor are set to an on state, and wherein the selection section is operated such that the first data line and the second data line are electrically connected to the signal line in the first selection period and the second data line is electrically connected to the signal line in the second selection period.

For example, in JP-A-2008-304690 described above, the gate-source voltage of the driving transistor immediately before the plurality of selection periods is set to a threshold voltage of the driving transistor. In JP-A-2008-304690, the driving circuit makes the gate-source voltage of the driving transistor approach the threshold voltage in a manner such that a current flows to the driving transistor while maintaining the potential of the gate of the driving transistor at a predetermined value in a period (compensation period) before the plurality of selection periods. However, as the gate-source voltage of the driving transistor becomes closer to the threshold voltage, the value of the current flowing to the driving transistor becomes smaller and the temporal change rate of the gate-source voltage of the driving transistor becomes much smaller. Therefore, it takes a long time until the value of the current flowing to the driving transistor certainly becomes zero (until the gate-source voltage of the driving transistor certainly reaches the threshold voltage). On the contrary, in the invention, the driving circuit sets the potential of the gate of the driving transistor to the initialization potential and controls the current generating section so that the set current with a constant magnitude flows to the driving transistor in the set period before the plurality of selection periods, so that the gate-source voltage (the voltage across both terminals of the first capacitance element) of the driving transistor is set to a value necessary for causing the set current to flow to the driving transistor. Accordingly, there is an advantage in that the length of time necessary for setting the gate-source voltage of the driving transistor to a desired value immediately before the plurality of selection periods may be remarkably shorter than that of JP-A-2008-304690.

In the electro-optical device according to the aspect, the current generating section may include a power feeding line (14) and a second capacitance element (C2) including a first electrode (L1) and a second electrode (L2). The first electrode may be connected to the node, and the second electrode may be connected to the power feeding line. The driving circuit may temporally change the potential output to the power feeding line in the plurality of selection periods and the writing period within the unit period. In this aspect, the set current becomes a value in accordance with a temporal change rate of the potential output to the power feeding line. For example, when the potential output to the power feeding line linearly changes in accordance with a constant temporal change rate, the value of the set current becomes constant, and the voltage across both terminals of the first capacitance element is set to a value necessary for causing the set current to flow to the driving transistor. According to this aspect, there is an advantage in that the gate-source voltage of the driving transistor may be easily adjusted to a desired value.

The electro-optical device according to the aspect is used in various electronic apparatuses. A typical example of the electronic apparatus is an apparatus using a light emitting device as a display device. As the electronic apparatus according to the aspect, a personal computer or a cellular phone may be exemplified. More than anything else, the usage of the light emitting device according to the aspect is not limited to the display of the image. For example, the light emitting device of the aspect is used as an exposure device (an optical head) used for forming a latent image on an image carrier such as a photosensitive drum by the irradiation of a beam.

The aspect is also specified as a method of driving an electro-optical device at a cycle of a unit period. The driving method according to the aspect is a method of driving an electro-optical device at a cycle of a unit period, the electro-optical device including a plurality of pixel circuits each of which is disposed so as to correspond to each intersection between a plurality of scanning lines and a plurality of data lines sorted as a plurality of blocks each having data lines and a plurality of signal lines each of which corresponds one-to-one to the plurality of blocks, each of the plurality of pixel circuits including a selection transistor that writes a data potential of the data line as an on state in the pixel circuit and a light emitting element that emits light with luminance in accordance with the written data potential, wherein the unit period includes a plurality of selection periods and a writing period after the plurality of selection periods, wherein the data potential in accordance with the luminance of the light emitting element of the pixel circuit corresponding to each intersection between the scanning line to be selected in the unit period and each data line included in the block corresponding to the signal line is sequentially output to each signal line, and the data line corresponding to the pixel circuit to be used to supply the data potential output to the signal line corresponding to the selection section in the corresponding selection period and the data line corresponding to the pixel circuit to be used to supply the data potential output to the signal line in the selection period after the corresponding section period are selected to be electrically connected to the signal line in the plurality of selection periods, and wherein the data potential written to the data line corresponding to the pixel circuit is supplied to each of the plurality of pixel circuits corresponding to the scanning line to be selected in the unit period in the writing period. Even in the driving method, the same advantage as that of the electro optical-device according to the aspect is obtained.

The aspect is also specified as a method of driving an electro-optical device. The driving method according to the aspect is a method of driving an electro-optical device including a first pixel circuit which is disposed so as to correspond to first intersection between a scanning line and a first data line, a second pixel circuit which is disposed so as to correspond to second intersection between a scanning line and a second data line, a signal line, the first pixel circuit including a first selection transistor and a first light emitting element, the second pixel circuit including a second selection transistor and a second light emitting element, the method comprising: outputting a first data potential to the signal line and connecting electrically the first data line and the second data line to the signal line in a first selection period; outputting a second data potential to the signal line and connecting electrically the second data line to the signal line in a second selection period; supplying the first data potential output to the first data line through the first selection transistor to the first pixel circuit and supplying the second data potential output to the second data line through the second selection transistor to the second pixel circuit in a writing period after the first selection period and the second selection period.

BRIEF DESCRIPTION OF THE DRAWINGS

The invention will be described with reference to the accompanying drawings, wherein like numbers reference like elements.

DESCRIPTION OF EXEMPLARY EMBODIMENTS

A: FIRST EMBODIMENT

Figure 1:
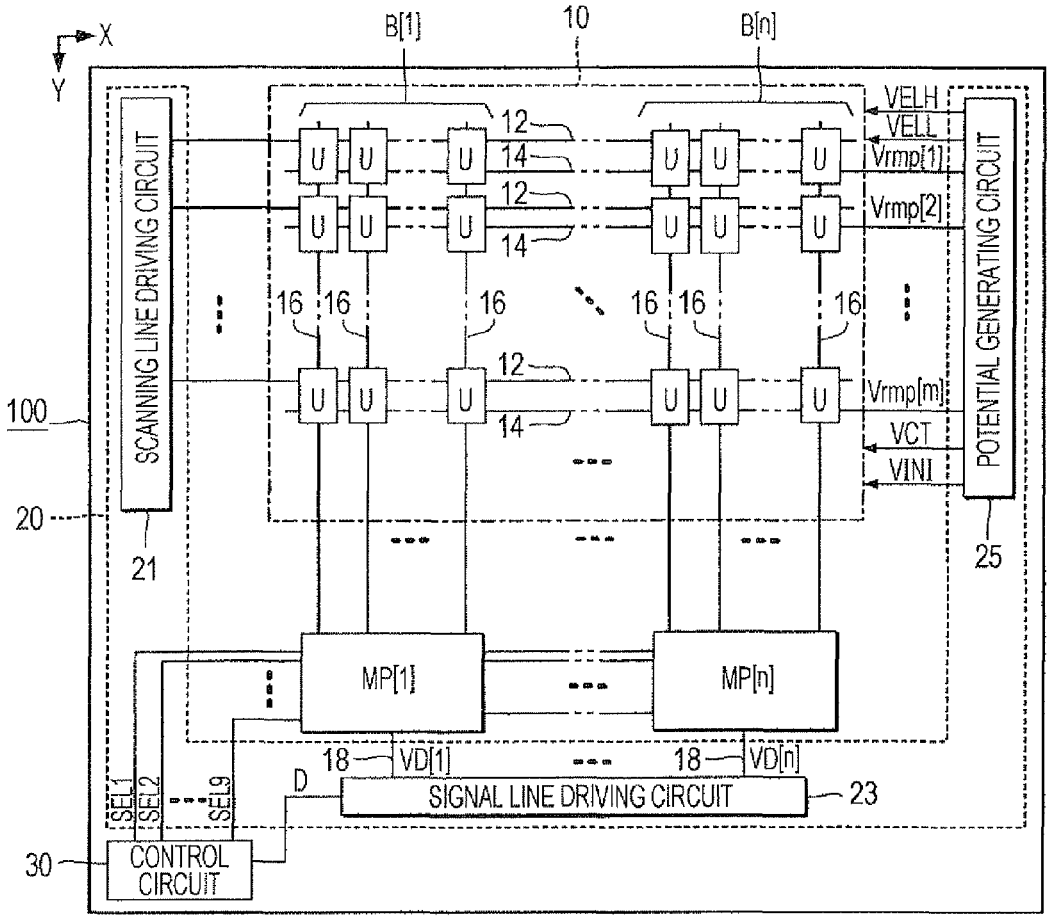
FIG. 1 is a block diagram illustrating an electro-optical device according to a first embodiment of the invention.

FIG. 1 is a block diagram illustrating a configuration of an electro-optical device 100 according to a first embodiment of the invention. The electro-optical device 100 is a device employed in various electronic apparatuses to display an image thereon. As shown in FIG. 1, the electro-optical device 100 includes an element section 10 in which a plurality of pixel circuits U is disposed in a matrix shape. The element section 10 is provided with m pairs of interconnection groups 12 which extend in the X direction and m-number of ramp power feeding lines 14 each of which makes a pair with interconnection group 12 and which extend in the X direction, and 9n number of data lines 16 which extend in the Y direction intersecting the X direction (m and n are integers). Each of the plurality of pixel circuits U is disposed at the intersection between the pair of the interconnection group 12 and the ramp power feeding line 14 and the data line 16, so that they are arranged in a matrix shape of m columns by 9n rows. Further, in the embodiment, 9n number of data lines 16 are sorted as n number of blocks B (B[1], B[2], and B[n]) which are nine blocks adjacent to each other as each unit.

As shown in FIG. 1, the electro-optical device 100 further includes a driving circuit 20 that drives each pixel circuit U, n number of signal lines 18 each of which is provided to correspond one-to-one to each of n number of blocks B[1] to B[n], each data line 16 which is disposed to correspond one-to-one to each of the n number of blocks B[1] to B[n] and is included in the corresponding block B, n number of selection sections MP (MP[1] to MP[n]) which switch the connection and disconnection with signal line 18 corresponding to the block B, and a control circuit 30. As shown in FIG. 1, the driving circuit 20 includes a scanning line driving circuit 21, a signal line driving circuit 23, a potential generating circuit 25, and a data line initialization section (not shown in FIG. 1) to be described later. The driving circuit 20 is mounted on, for example, a plurality of integrated circuits in a distributed manner. However, at least a part of the driving circuit 20 may be formed as a thin film transistor formed on a substrate together with pixel circuit U.

The control circuit 30 outputs a signal defining an operation of the electro-optical device 100 to the driving circuit 20 or each of the selection sections MP[1] to MP[n]. In the embodiment, the control circuit 30 outputs selection signals SEL1 to SEL9 respectively defining the operations of the selection sections MP[1] to MP[n] to the selection sections MP[1] to MP[n]. Further, the control circuit 30 outputs grayscale data D representing a designated grayscale of each pixel circuit U or a control signal (not shown) such as a clock signal to the signal line driving circuit 23. Furthermore, the control circuit 30 outputs a control signal (not shown) such as a clock signal to the scanning line driving circuit 21 or the potential generating circuit 25.

The scanning line driving circuit 21 is a circuit that sequentially selects the plurality of pixel circuits U by the unit of the row in each of m number of horizontal scanning periods H (H[1] to H[m]) within each vertical scanning period. The signal line driving circuit 23 generates n-phase grayscale signals VD[1] to VD[n] from the grayscale data D of each pixel circuit U output by the control circuit 30 and outputs the signal to the signal lines 18 in parallel. For example, the grayscale signal VD[j] output to the signal line 18 corresponding to the j-th ($1 \leq j \leq n$) block B[j] is a voltage signal in which the data potential DT in accordance with each grayscale data D of nine pixel circuits U respectively corresponding to the intersections between the row selected by the scanning line driving circuit 21 and the data lines 16 for nine columns included in the block B[j] is output by time-division.

Figure 2:
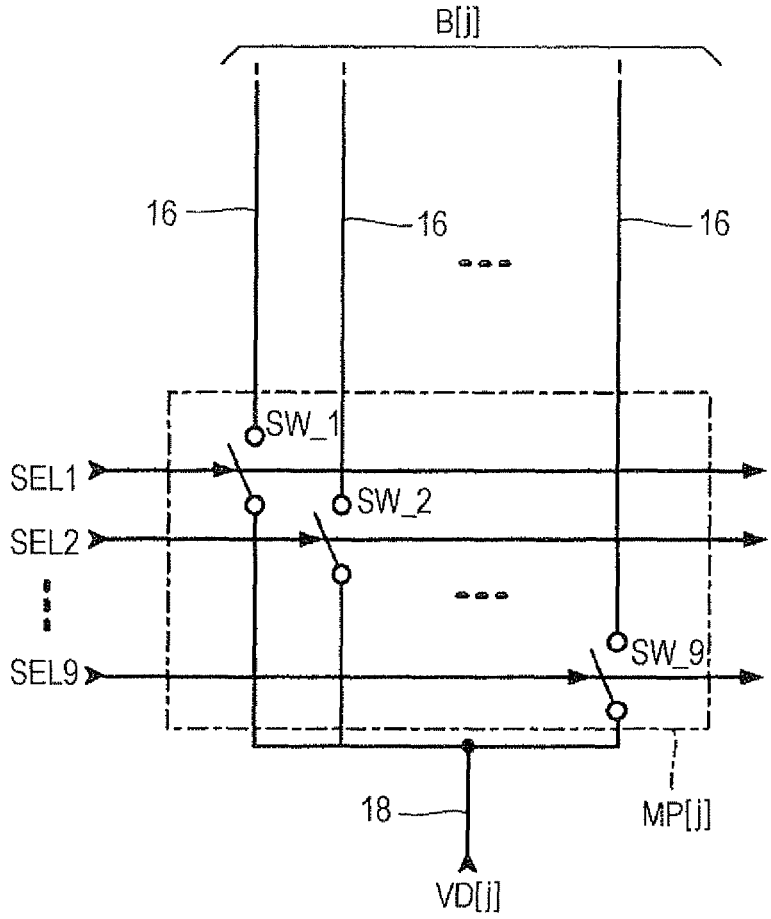
FIG. 2 is a circuit diagram illustrating a selection section.

Each of the selection sections MP[1] to MP[n] serves as a section that distributes a grayscale signal VD output to the signal line 18 corresponding to the block B with respect to nine data lines 16 included in the block B corresponding to the selection section MP. FIG. 2 is a circuit diagram illustrating the selection section MP. In FIG. 2, only the j-th selection section MP[j] corresponding to the j-th block B[j] is representatively exemplified, but the other selection sections MP also have the same configuration. As shown in FIG. 2, the selection section MP[j] include nine switches SW (SW_ to SW_9) corresponding to the number of data lines 16 within the block B[j] corresponding to the selection section MP[j]. The switches SW_k (k=1 to 9) of the selection section MP[j] are interposed between the k-th data lines 16 and the output terminal of the j-th signal line 18 within the block B[j] so as to control the electrical connection (connection/disconnection) therebetween. The control circuit 30 commonly supplies nine channels of selection signals SEL1 to SEL9 to the n number of selection sections MP[1] to Mp[n]. The selection signals SELk (k=1 to 9) are commonly supplied to the switches SW_k of the selection sections MP[1] to MP[n] so as to control the opened and closed state.

Returning to FIG. 1, the description is continued. As shown in FIG. 1, the potential generating circuit 25 generates a high potential VELH of the power supply, a reset potential YELL, a low potential VCT of the power supply, a ramp potential Vrmp, and an initialization potential VINI. The potential VELH is supplied to a power feeding line 41 shown in FIG. 3. The power feeding line 41 is commonly connected to each pixel circuit U. The potential VELL is supplied to a power feeding line 43 shown in FIG. 3. The power feeding line 43 is commonly connected to each pixel circuit U. The potential VCT is supplied to a power feeding line 45 shown in FIG. 3. The power feeding line 45 is commonly connected to each pixel circuit U. The initialization potential VINI is supplied to an initialization line 47 shown in FIG. 3. Further, the potential generating circuit 25 individually outputs the ramp potential Vrmp to each ramp power feeding line 14. Here, the ramp potential output to the i-th ramp power feeding line 14 is marked as Vrmp[i].

Figure 3:
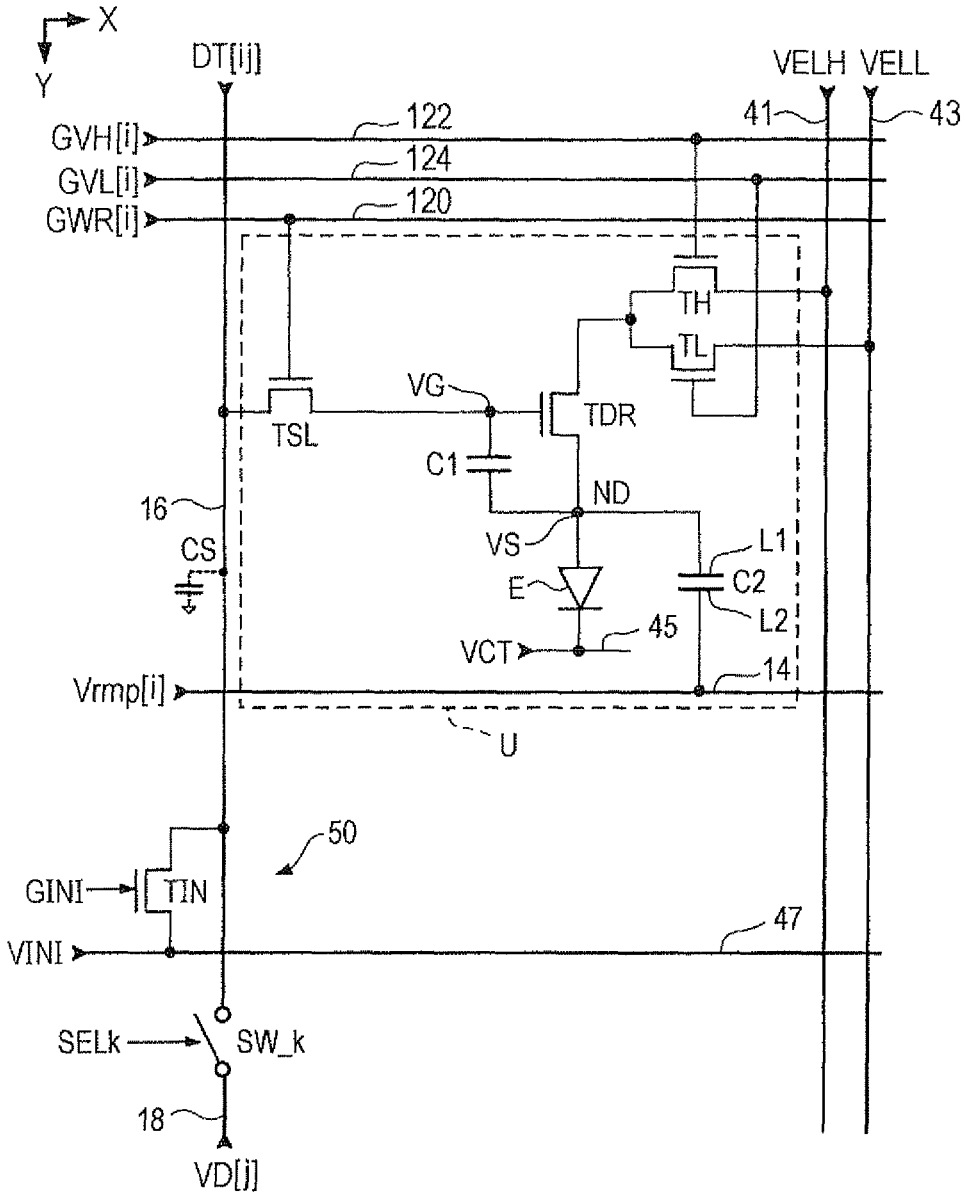
FIG. 3 is a circuit diagram illustrating a pixel circuit.

FIG. 3 is a circuit diagram illustrating the pixel circuit U. In FIG. 3, only one pixel circuit U positioned at the k-th position within the j-th block B[j] included in the i-th ($1 \leq i \leq m$) row is representatively shown. As shown in FIG. 3, the pixel circuit U includes a light emitting element E, a driving transistor TDR, a first capacitance element C1, a second capacitance element C2, a selection transistor TSL, and power supply switching transistors TH and TL. The interconnection group 12 depicted by one line in FIG. 1 includes a scanning line 120, a control line 122, and a control line 124 as shown in FIG. 3. Further, each data line 16 has a capacitance Cs.

The driving transistor TDR and the light emitting element E are respectively connected to each other in series in the path between each of the power feeding line 41 and the power feeding line 43 and the power feeding line 45. The light emitting element E is an OLED element in which a light emitting layer formed of an organic EL material is interposed between an anode and a cathode facing each other, and emits light with luminance in accordance with the value of the driving current generated by the driving transistor TDR. The cathode of the light emitting element E is connected to the power feeding line 45.

The driving transistor TDR is an N-channel-type thin film transistor, and generates a driving current with a current value in accordance with a voltage VGS (=VG−VS) as a difference between the potential VG of the gate and the potential VS of the source. The source of the driving transistor TDR is connected to the anode of the light emitting element E. Further, an N-channel-type transistor TH is disposed between the drain of the driving transistor TDR and the power feeding line 41, and an N-channel-type transistor TL is disposed between the drain of the driving transistor TDR and the power feeding line 43. The gate of the transistor TH is connected to the control line 122, and an on and off state thereof is controlled in accordance with a control signal GVH[i] output to the control line 122. On the other hand, the gate of the transistor TL is connected to the control line 124, and an on and off state thereof is controlled in accordance with a control signal GVL [i] output to the control line 124. In the embodiment, the transistor TH and the transistor TL are operated in a complementary manner. More specifically, when the transistor TH is in an on state, the transistor TL becomes an off state. When the transistor TH is in an off state, the transistor TL becomes an on state.

The first capacitance element C1 is interposed between the gate and the source of the driving transistor TDR. Further, the second capacitance element C2 is interposed between the i-th ramp power feeding line 14 and a node ND (corresponding to the source of the driving transistor TDR) interposed between the light emitting element E and the driving transistor TDR on the path connecting each of the power feeding line 41 and the power feeding line 43 and the power feeding line 45. The second capacitance element C2 includes a first electrode L1 connected to the node ND and a second electrode L2 connected to the i-th ramp power feeding line 14. In the embodiment, the second capacitance element C2 and the ramp power feeding line 14 serve as a current generating section used to generate a set current Is to be described later.

The selection transistor TSL is disposed between the gate of the driving transistor TDR and the data line 16. For example, an N-channel-type transistor (thin film transistor) is appropriately adopted as the selection transistor TSL. The gates of the selection transistors TSL of n number of pixel circuits U included in the i-th row are commonly connected to the i-th scanning line 120.

Further, the electro-optical device 100 of the embodiment further includes a data line initialization section 50 that initializes the potential of each data line 16. As shown in FIG. 3, the data line initialization section 50 includes a plurality of (9n number of) initialization transistors Tin disposed between 9n number of data lines 16 and the initialization line 47 and corresponding one-to-one to 9n number of data lines 16. An initialization signal GINI is commonly supplied to the gates of 9n number of initialization transistors Tin.

Figure 4:
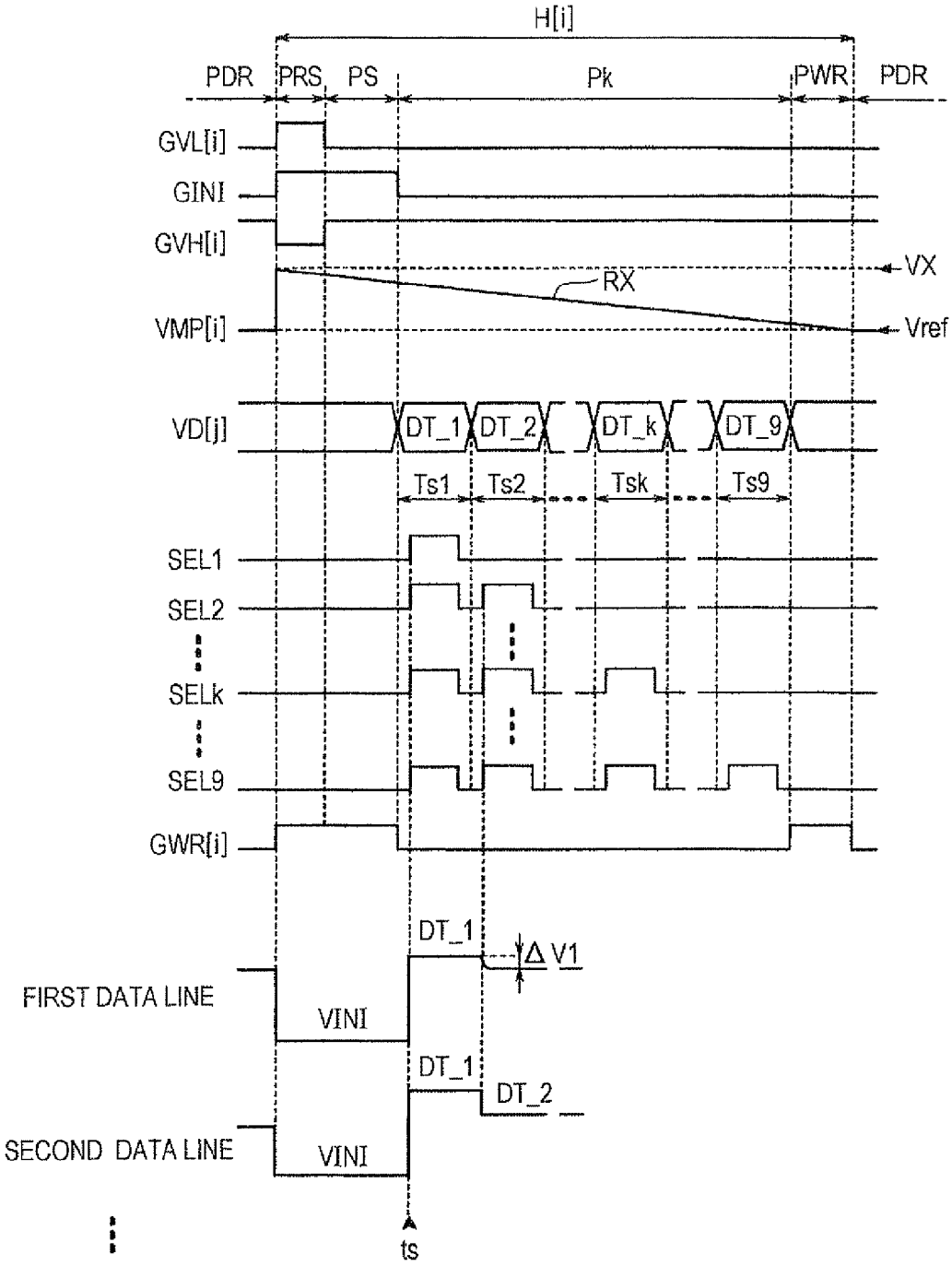
FIG. 4 is a timing chart illustrating an operation of the pixel circuit.

FIG. 4 is a timing chart illustrating an operation of the electro-optical device 100 according to the embodiment. In FIG. 4, only the i-th horizontal scanning period H[i] is exemplified, but each of the horizontal scanning periods H[1] to H[m] includes an initialization period PRS, a set period PS after the initialization period PRS, a data output period Pk after the set period PS, and a writing period PWR after the data output period Pk. The period between the end of the i-th horizontal scanning period H[i] of a certain vertical scanning period and the start of the i-th horizontal scanning period H[i] of the next vertical scanning period is set as a light emission period PDR.

The scanning line driving circuit 21 of FIG. 1 generates scanning signals GWR[1] to GWR[m] and outputs the signals to the respective scanning lines 120. As shown in FIG. 4, the scanning signal GWR[i] output to the i-th scanning line 120 is set to an active level (a high level) in the initialization period PRS, the set period PS, and the writing period PWR within the horizontal scanning period H[1]. Here, the "selection of the i-th scanning line 120" indicates that the scanning signal GWR[i] is set to a high level in the writing period PWR within the horizontal scanning period H[i]. Further, the scanning line driving circuit 21 generates the control signals GVH[1] to GVH[m], the control signals GVL[1] to GVL[m], and the initialization signal GINI, and outputs the signals. The control signal GVH[i] is supplied to the i-th control line 122, and the control signal GVL[i] is supplied to the i-th control line 124. Furthermore, the initialization signal GINI is commonly supplied to the gates of 9n number of initialization transistors Tin.

The signal line driving circuit 23 of FIG. 1 outputs the grayscale signal VD, designating a grayscale of the pixel circuit U corresponding to each intersection between the scanning line 120 to be selected in the horizontal scanning period H and each data line 16 included in the block B corresponding to the signal line 18, to each signal line 18 in the data output period Pk within each horizontal scanning period H (H[1] to H[m]). At this time, the selection sections MP[1] to MP[n] sequentially select the data lines 16 included in the block B corresponding to the selection section MP so as to be electrically connected to the signal line 18 corresponding to the block B.

As shown in FIG. 4, the data output period Pk within each horizontal scanning period H includes a plurality of (nine) selection periods Ts1 to Ts9. When attention is paid to the j-th block B[j], the grayscale signal VD[j] output to the signal line 18 corresponding to the block B[j] is sequentially set in the data potential DT (DT_1 to DT_9) in accordance with each grayscale data D of nine pixel circuits U respectively corresponding to the intersections between the data lines 16 included in the block B[j] and the scanning line 120 to be selected in the horizontal scanning period H in nine selection periods Ts1 to Ts9 within each horizontal scanning period H. More specifically, the grayscale signal VD[j] output to the signal line 18 corresponding to the block B[j] in the k-th ($1 \leq k \leq 9$) selection period Tsk within each horizontal scanning period H indicates a state where the setting is performed using the data potential DT_k in accordance with the grayscale data D of the pixel circuit U corresponding to the intersection between the k-th data line 16 inside the block B[j] and the scanning line 120 to be selected in the horizontal scanning period H. The same applies to the grayscale signal VD output to the other signal lines 18.

Further, in each of the plurality of selection periods Ts, the selection section MP[j] corresponding to the block B[j] selects the data line 16 corresponding to the pixel circuit U to be used to supply the data potential DT output to the signal line 18 (the j-th signal line 18) corresponding to the selection section MP[j] in the selection period Ts and the data line 16 corresponding to the pixel circuit U to be used to supply the data potential DT output to the j-th signal line 18 in the selection period Ts after the above-described selection period Ts so as to be electrically connected to the j-th signal line 18. More specifically, in the k-th selection period Tsk, the selection section MP[j] selects the k-th data line 16 corresponding to the pixel circuit U to be used to supply the data potential DT_K output to the j-th signal line 18 in the selection period Tsk and the data line 16 (that is, the k+1-th to ninth data lines 16) corresponding to the pixel circuit U to be used to supply the data potential DT output to the j-th signal line 18 in the selection periods Tsk+1 to Ts9 after the above-described selection period Ts so as to be electrically connected to the j-th signal line. That is, as shown in FIG. 4, in the k-th selection period Tsk, the selection signals SELk to SEL9 are set to an active level (a high level) in a batch. Accordingly, in the selection period Tsk, the data potential DT_k set as the grayscale signal VD[j] is supplied to the k-th to ninth data lines 16 within the block B[j] in a batch via the switches SW_k to SW_9 of the selection section MP[i].

In the description below, the operation of the k-th pixel circuit U within the j-th block B[j] included in the i-th row will be described according to each of the initialization period PRS, the set period PS, the data output period Pk, the writing period PWR, and the light emission period PDR. Furthermore, for convenience of description, k is set to any one of numbers 2 to 8.

(a) Initialization Period PRS

Figure 5:
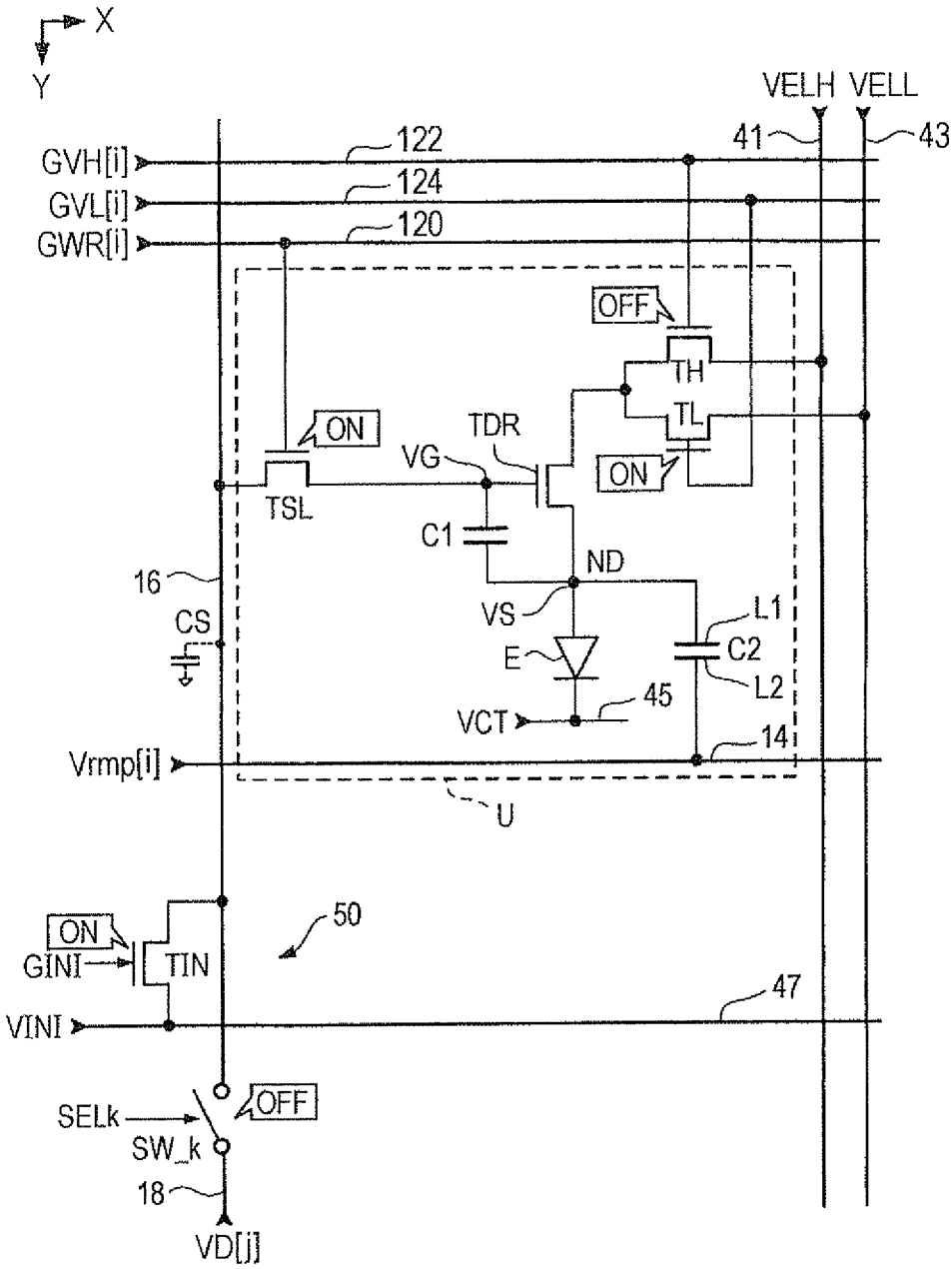
FIG. 5 is a diagram illustrating an operation of the pixel circuit in an initialization period.

As shown in FIG. 4, when the initialization period PRS starts, the driving circuit 20 (the scanning line driving circuit 21) sets the initialization signal GINI to an active level (a high level). Therefore, as shown in FIG. 5, the initialization transistor TIN is set to an on state. Since each data line 16 is electrically connected to the initialization line 47 via the initialization transistor TIN which is in an on state, the potential of each data line 16 is set to the initialization potential VINI. Further, at this time, since the switches SW_1 to SW_9 of each selection section MP[j] are set to an off state, each data line 16 in each block B is not electrically connected to the signal line 18 corresponding to the block B.

Further, as shown in FIG. 4, the driving circuit 20 (the scanning line driving circuit 21) sets the scanning signal GWR[i] and the control signal GVL[i] to an active level (a high level), and sets the control signal GVH[i] to a non-active level (a low level). Therefore, as shown in FIG. 5, the selection transistor TSL and the transistor TL are set to an on state, and the transistor TH is set to an on state. Accordingly, since the gate of the driving transistor TDR is electrically connected to the data line 16 via the selection transistor TSL which is in an on state, the potential VG of the gate of the driving transistor TDR is set to the initialization potential VINI. Further, one electrode (drain) of the driving transistor TDR is electrically connected to the power feeding line 43 via the transistor TL which is in an on state. In the embodiment, since the voltage of a difference between the initialization potential VINI and the potential VELL of the power feeding line 43 is set to be sufficiently higher than the threshold voltage VTH of the driving transistor TDR, the driving transistor TDR becomes an on state. Therefore, the potential VS of the source of the driving transistor TDR is set to the potential VELL. That is, the gate-source voltage of the driving transistor TDR VGS (the voltage across both terminals of the first capacitance element C1) is initialized by the voltage (|VINI−VELL|) as the difference between the initialization potential VINI and the potential VELL.

Further, since the potential VELL is set to a value in which a potential difference between the potential VELL and the potential VCT of the power feeding line 45 is sufficiently lower than the light emission threshold voltage VTH_OLED of the light emitting element E, the light emitting element E is set to an off state (non-light-emission state).

(b) Set Period

Figure 6:
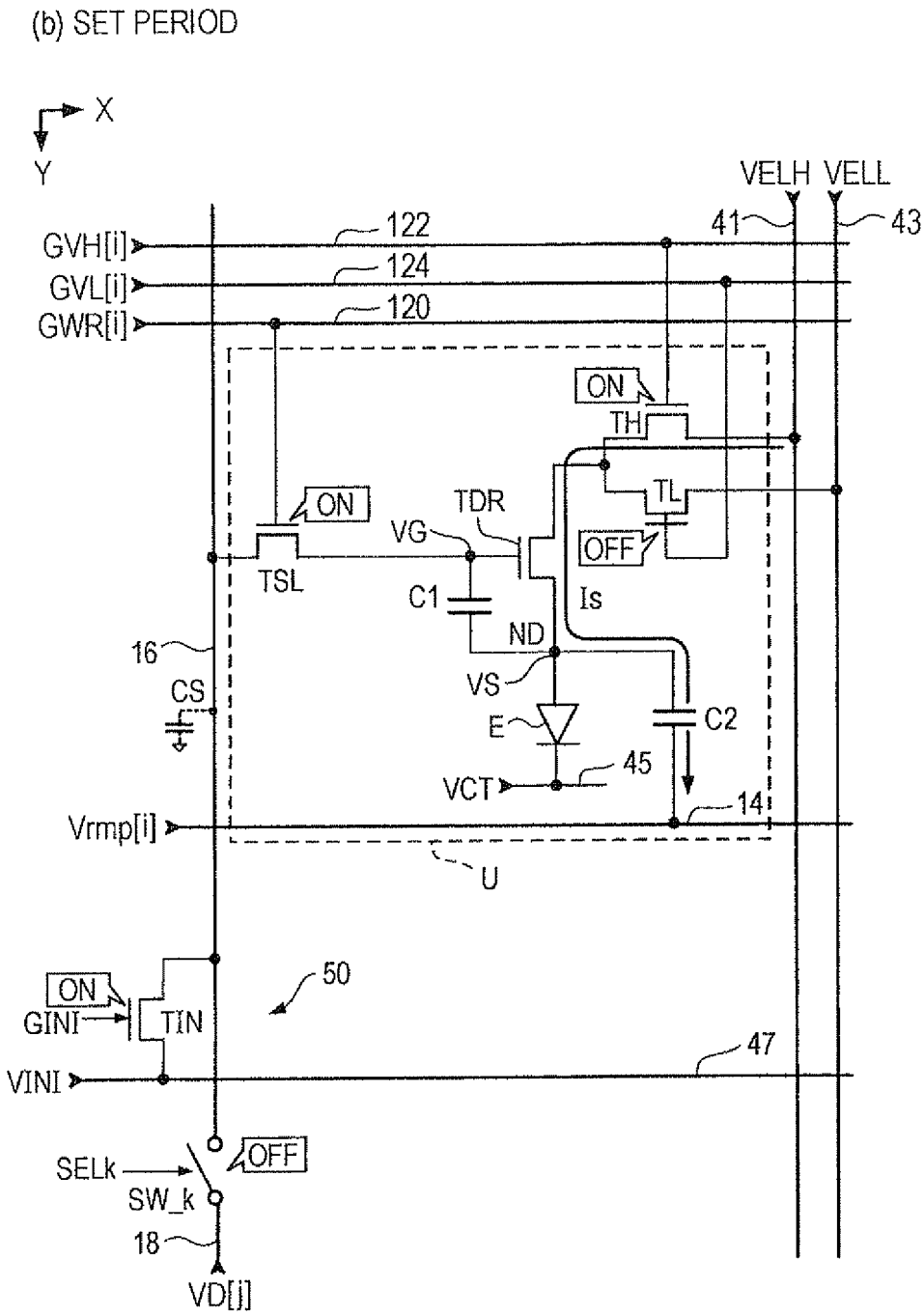
FIG. 6 is a diagram illustrating an operation of the pixel circuit in a set period.

As shown in FIG. 4, when the set period PS starts, the driving circuit 20 (the scanning line driving circuit 21) sets the control signal GVH[i] to a high level, and sets the control signal GVL[i] to a low level. The other signals are maintained at the same level as those of the initialization period PRS. Therefore, as shown in FIG. 6, the transistor TH is set to an on state, and the transistor TL is set to an off state. Accordingly, the current flowing from the power feeding line 41 flows to the driving transistor TDR, so that the potential VS of the source of the driving transistor TDR starts to increase. Since the potential VG of the gate of the driving transistor TDR is maintained at the initialization potential VINI, the gate-source voltage of the driving transistor TDR gradually decreases. At this time, the driving circuit 20 (the potential generating circuit 25) generates a predetermined magnitude of a set current Is flowing to a path branched from a path reaching the light emitting element E from the power feeding line 41 via the node ND by temporally changing the ramp potential Vrmp[i] output to the i-th ramp power feeding line 14. More specifically, this is as follows.

As shown in FIG. 4, when the horizontal scanning period H[i] starts, the potential generating circuit 25 sets the ramp potential Vrmp[i] output to the i-th ramp power feeding line 14 to the start potential VX(>Vref) from the reference potential Vref. Then, the ramp potential Vrmp[i] linearly decreases with a temporal change rate RX (RX=dVrmp/DT) from the start point to the end point of the horizontal scanning period H[i]. In the embodiment, the potential generating circuit 25 linearly decreases the ramp potential Vrmp[i] so that the value of the ramp potential. Vrmp[i] becomes equal to the reference potential Vref at the end point of the horizontal scanning period H[i]. When the capacitance of the second capacitance element C2 is denoted by Cp and the charge stored in the second capacitance element C2 is denoted by Q, in the set period PS, the set current Is flowing from the power feeding line 41 to the i-th ramp power feeding line 14 via the node ND and the second capacitance element C2 is expressed by the following equation (1).

$$Is=dQ/dt=Cp\times dVrmp/dt=Cp\times dRX/dt \quad (1)$$

In the embodiment, since the temporal change rate Rx of the ramp potential Vrmp is constant, the value of the set current Is becomes constant. Therefore, in the set period PS, the gate-source voltage of the driving transistor TDR approaches the voltage VGS1 necessary for causing a constant set current Is to flow to the driving transistor TDR. Likewise, each gate-source voltage of the driving transistor TDR is set to the voltage VGS1 necessary for causing the constant set current Is to flow to the driving transistor TDR. In the embodiment, the voltage VGS1 is expressed by the following equation (2).

$$VGS1=VTH+Va \quad (2)$$

Since the gate-source voltage of the driving transistor TDR substantially becomes equal to the voltage VGS1 necessary for causing the constant set current Is to flow to the driving transistor TDR at the end point of the set period PS, the potential VS of the source of the driving transistor TDR is set to the potential VINI-VGS1 lower than the initialization potential VINI (the potential VG of the gate) by the voltage VGS1. In the embodiment, the potential difference (the voltage across both terminals of the light emitting element E) between the potential VINI-VGS1 and the potential VCT of the power feeding line 45 is set to be lower than the light emission threshold voltage Vth_e1 of the light emitting element E. That is, even in the set period PS, the light emitting element E is in a non-light-emission state.

(c) Data Output Period Pk

Figure 7:
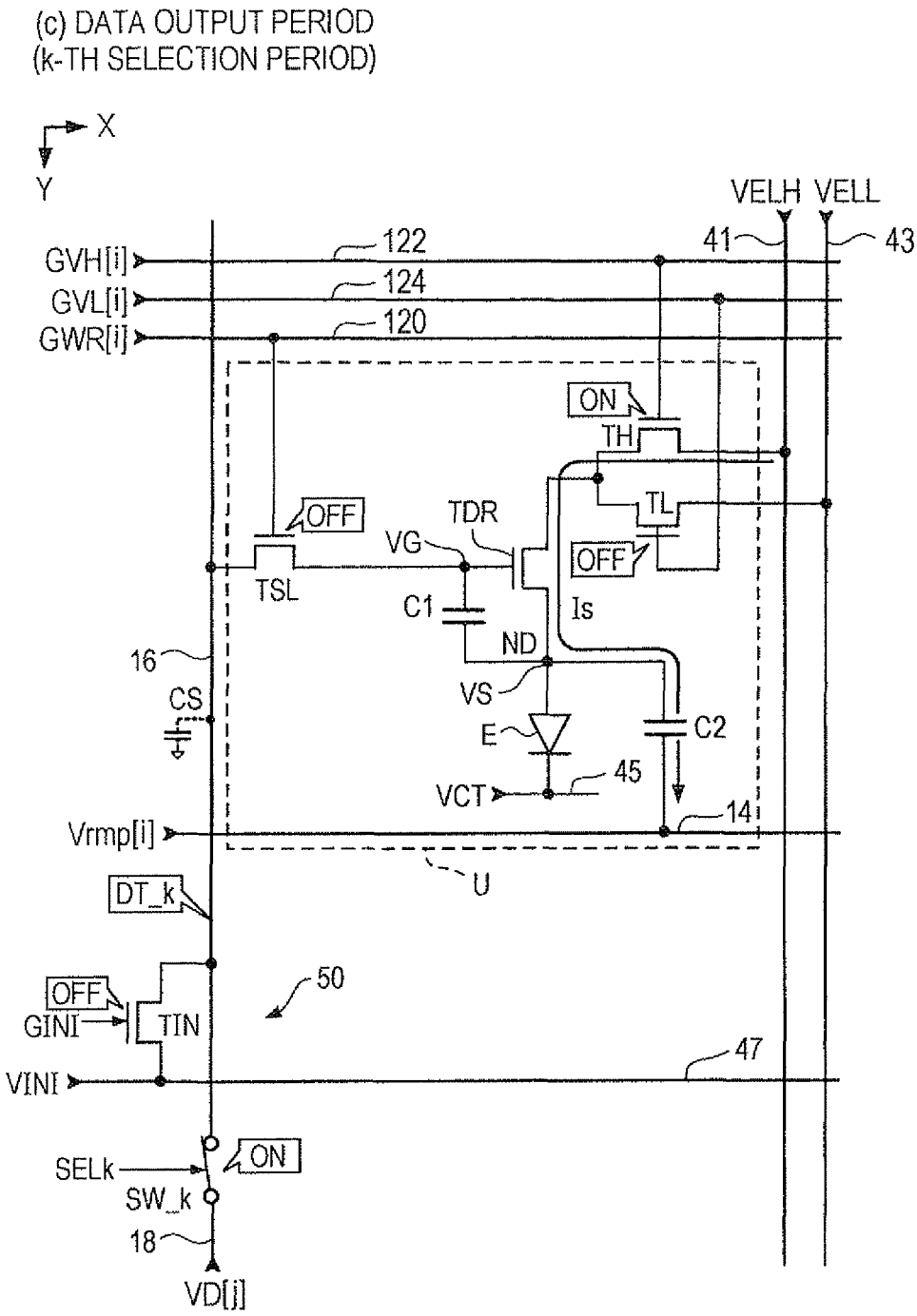
FIG. 7 is a diagram illustrating an operation of the pixel circuit in a data output period.

As shown in FIG. 4, when the data output period Pk starts, the driving circuit 20 (the scanning line driving circuit 21) sets the initialization signal GINI to a low level. Therefore, as shown in FIG. 7, since the initialization transistor TINT is set to an off state, each data line 16 and the initialization line 47 are not electrically connected to each other. Further, as shown in FIG. 4, the driving circuit 20 (the scanning line driving circuit 21) sets the scanning signal GWR[i] to a low level. Therefore, as shown in FIG. 7, the selection transistor TSL becomes an off state.

As shown in FIG. 4, in the data output period Pk, since the driving circuit 20 (the potential generating circuit 25) linearly decreases the ramp potential Vrmp[i] output to the i-th ramp power feeding line 14 at the temporal change rate RX as in the set period PS, the set current Is continuously flows to a path reaching the i-th ramp power feeding line 14 from the node ND via the second capacitance element C2. Here, as the mobility μ of the driving transistor TDR becomes larger, the value of the current flowing to the driving transistor TDR becomes larger and an increase amount of the potential VS of the source becomes larger. On the contrary, as the mobility μ becomes smaller, the value of the current flowing to the driving transistor TDR becomes smaller. That is, a decrease amount (a negative feedback amount) of the gate-source voltage of the driving transistor TDR becomes larger as the mobility μ becomes larger, and the decrease amount (the negative feedback amount) of the gate-source voltage becomes smaller as the mobility μ becomes smaller. Accordingly, the non-uniformity of the mobility for each pixel circuit U is compensated.

Further, as shown in FIG. 4, the selection signal SETA is set to a high level for each of the first selection period Ts1 to the k-th selection period Tsk. Therefore, in each of the first selection period Ts1 to the k-th selection period Tsk, the data potential DT output to the j-th signal line 18 in the selection period Ts is supplied to the k-th data line 16 inside the block B[j] via the switch SW_k. For example, in the first selection period Ts1, the data potential DT_1 in accordance with the grayscale data D of the pixel circuit U corresponding to the first data line 16 is supplied to the k-th data line 16 via the switch SW_k. In the k-th selection period Tsk, the data potential DT_k in accordance with the grayscale data D of the pixel circuit U corresponding to the k-th data line 16 is supplied to the k-th data line 16 via the switch SW_k.

Furthermore, as shown in FIG. 4, when the selection period Tsk ends, the selection signal SELk is set to a low level for a period until the data output period Pk in the next horizontal scanning period H[i+1] starts. Accordingly, the switch SW_k is set to an off state, so that the k-th data line 16 is in an electrical floating state. As described above, since the capacitance Cs is present in the data line 16, the data potential DT_k written to the k-th data line 16 in the selection period Tsk is maintained by the capacitance Cs.

Figure 8:
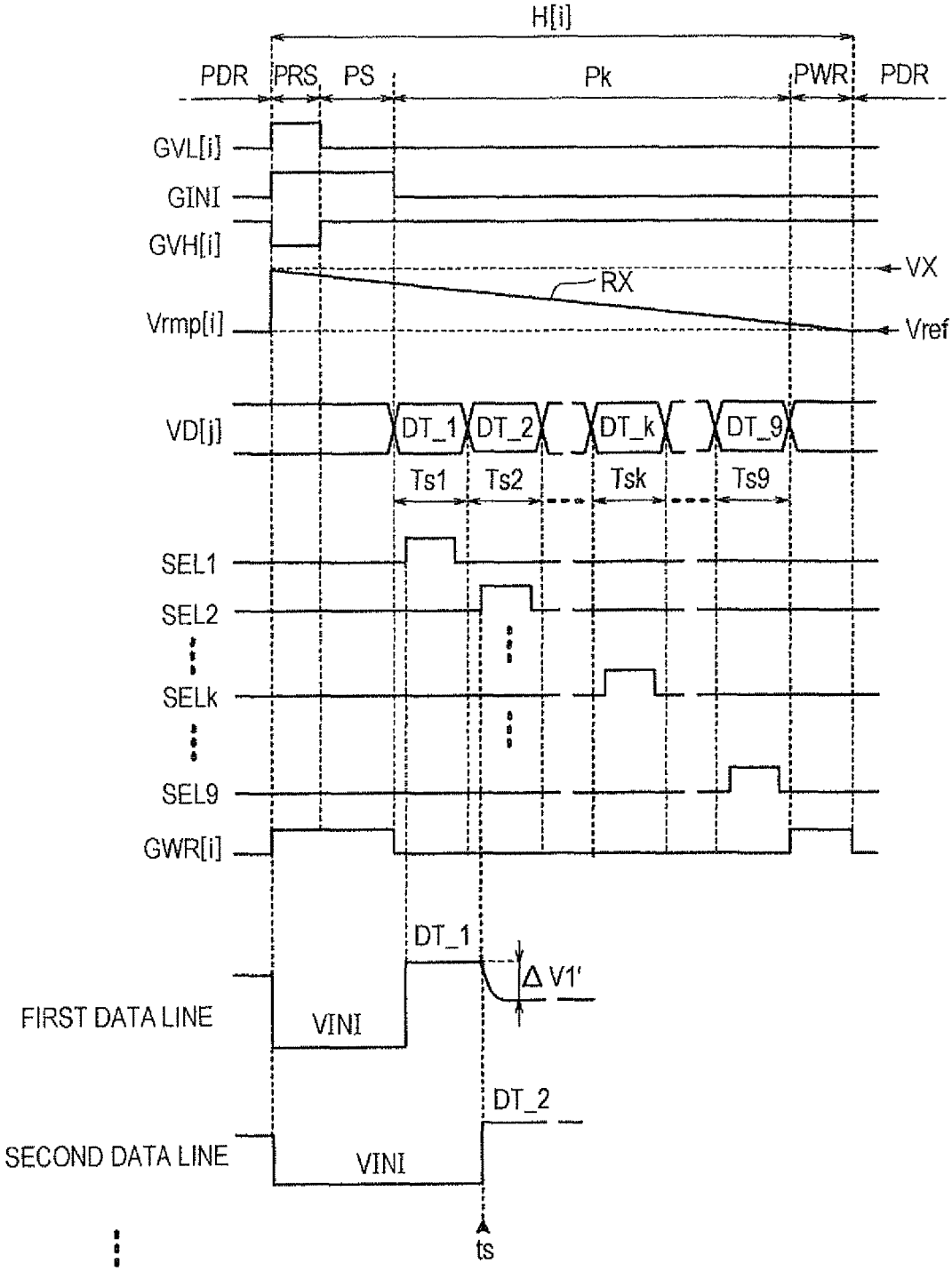
FIG. 8 is a timing chart illustrating an operation of a comparative example.

Incidentally, since a parasitic capacitance (not shown) is present between the adjacent data lines 16, the adjacent data lines 16 in the block B[j] are capacitively coupled to each other. For example, the first data line 16 is capacitively coupled to the second data line 16. Here, an example ("comparative example") is assumed in which the selection section MP[j] selects only the data line 16 corresponding to the pixel circuit U to be used to supply the data potential DT output to the j-th signal line 18 in the selection period Ts to be electrically connected to the j-th signal line 18 in each of the plurality of selection periods Ts1 to Ts9. FIG. 8 is a timing chart illustrating an operation of the comparative example.

As shown in FIG. 8, for example, the selection signal SEL2 is set to a high level only in the second selection period Ts2 in the data output period Pk, and is set to a low level in the other periods. Therefore, since the potential of the second data line 16 is maintained at the initialization potential VINI immediately before the selection period Ts2, the potential of the second data line 16 changes from the initialization potential VINI to the potential DT_2 at the supply start time point ts of the data potential DT_2 with respect to the second data line 16. Furthermore, the initialization potential VINI is set to a sufficiently small value compared to the value of the data potential DT. At this time, since the first data line 16 is in an electrical floating state, when the second data line 16 changes from the time point ts as shown in FIG. 8, the potential of the first data line 16 capacitively coupled to the second data line 16 changes from the potential DT_1 written at the first selection period Ts1 by the potential ΔV1' in accordance with the change amount (VINI→DT_2) of the potential of the second data line 16. Accordingly, the potential of the first data line 16 is deviated from the desired value DT_1. Here, the first data line 16 and the second data line 16 in the adjacent data lines 16 in the block B[j] are adopted for description, but the same phenomenon occurs even in the other adjacent data lines 16.

On the contrary, in the embodiment, since the data potential DT_1 sufficiently larger than the initialization potential VINI is written to the second data line 16 in the block B[j] (at the first selection period Ts1) immediately before the second selection period Ts2, the change amount (|DT_1−DT2|) of the potential of the second data line 16 at the second selection period Ts2 largely decreases compared to the comparative example (|VINI−DT_2|). That is, according to the embodiment, since the change amount ΔV1 of the potential of the first data line 16 generated with the writing of the data potential DT_2 to the second data line 16 may be reduced compared to the comparative example (ΔV1'), there is an advantage in that the potential of the first data line 16 may be maintained at a value close to the desired value DT_1. The same applies to the other data lines 16.

(d) Writing Period PWR

Figure 9:
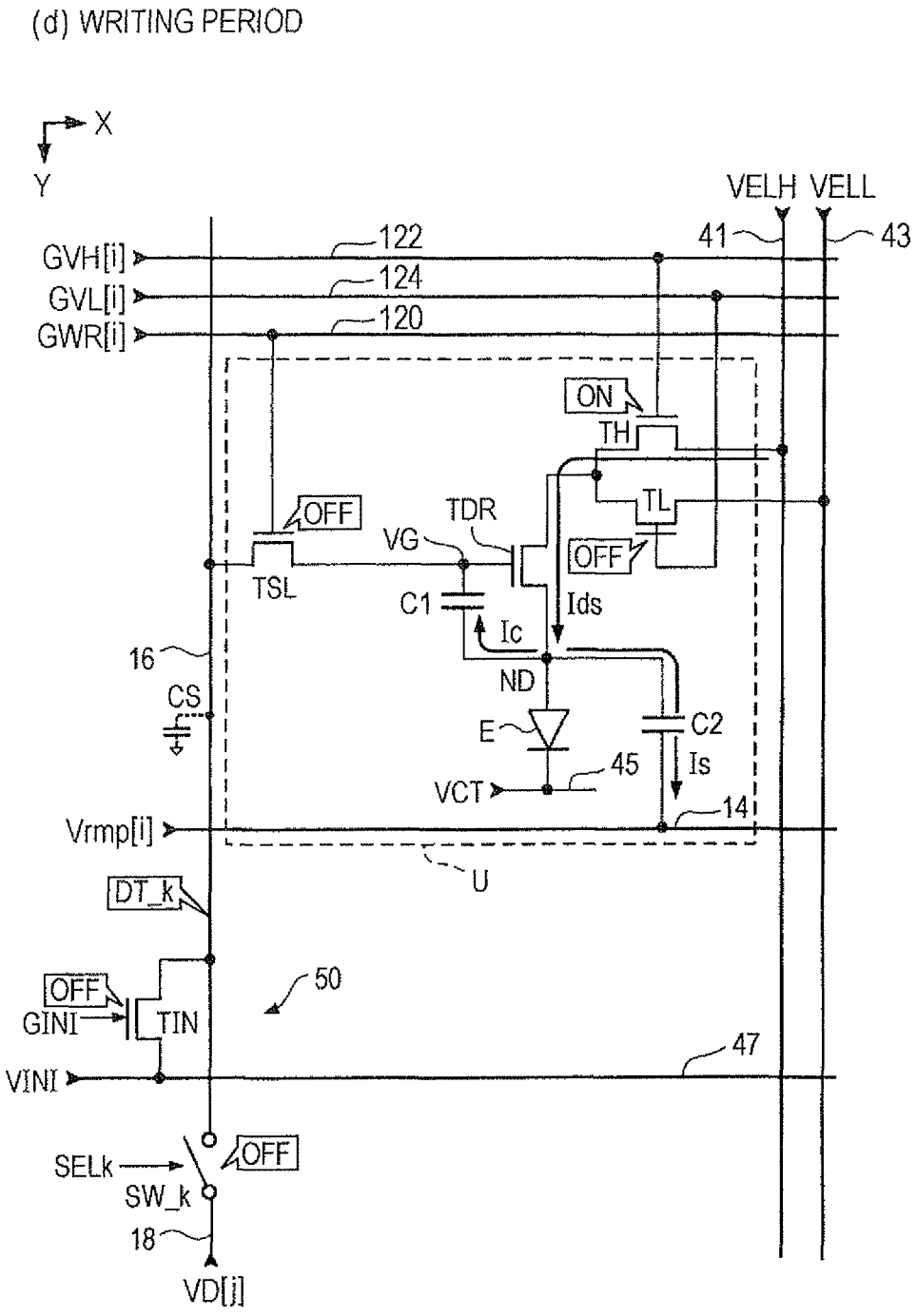
FIG. 9 is a diagram illustrating an operation of the pixel circuit in a writing period.

As shown in FIG. 4, when the writing period PWR starts, the driving circuit 20 (the scanning line driving circuit 21) sets the scanning signal GWR[i] to a high level. Therefore, as shown in FIG. 9, since the selection transistor TSL changes to an on state, the gate of the driving transistor TDR is electrically connected to the k-th data line 16 in the block B[j]. Accordingly, the potential VG of the gate of the driving transistor TDR is set to the data potential DT_k, and the current Ids in accordance with the data potential DT_k flows to the driving transistor TDR. When the current Ids flows to the driving transistor TDR, the potential VS of the source of the driving transistor TDR temporally increases, so that the gate-source voltage of the driving transistor TDR temporally decreases.

At this time, since the driving circuit 20 (the potential generating circuit 25) linearly decreases the ramp potential Vrmp[i] output to the i-th ramp power feeding line 14 at the temporal change rate RX as in the set period PS and the data output period Pk, the set current Is continuously flows to a path reaching the i-th ramp power feeding line 14 from the node ND via the second capacitance element C2. In this manner, the current Ids flowing to the driving transistor TDR is branched from the node ND into the set current Is flowing to the second capacitance element C2 and the current Ic (Ids−Is) flowing to the first capacitance element C1. As the value of the current Ids in accordance with the data potential DT_k becomes larger, the value of the current Ic flowing to the first capacitance element C1 becomes larger, so that an increase amount (that is, a decrease amount of the gate-source voltage) of the potential of the source of the driving transistor TDR becomes larger.

Further, as described above, the decrease amount (the negative feedback amount) of the gate-source voltage of the driving transistor TDR becomes larger as the mobility μ of the driving transistor TDR becomes larger, and the decrease amount (the negative feedback amount) of the gate-source voltage becomes smaller as the mobility μ becomes smaller. Accordingly, the non-uniformity of the mobility μ for each pixel circuit U is compensated. Such a mobility compensation operation is performed throughout the data output period Pk and the writing period PWR, and the gate-source voltage of the driving transistor TDR (the voltage across both terminals of the first capacitance element C1) at the end point of the writing period PWR is set to a value reflecting the data potential DT_k and the characteristic (the mobility μ) of the driving transistor TDR. The gate-source voltage of the driving transistor TDR VGS2 at the end point of the writing period PWR is expressed by the following equation (3).

$$VGS2=VGS1+\Delta V=VTH+Va+\Delta V \quad (3)$$

ΔV of the equation (3) becomes a value in accordance with the data potential DT_k and the characteristic (the mobility μ) of the driving transistor TDR.

In the embodiment, the driving circuit 20 performs the mobility compensation operation of each driving transistor TDR throughout the data output period Pk (the plurality of selection period Ts) and the writing period PWR in one horizontal scanning period H by controlling the charge amount of the second capacitance element C2 of each pixel circuit U so that the set current Is flows to each driving transistor TDR of the plurality of pixel circuits U corresponding to the scanning line 120 to be selected in one horizontal scanning period H at the data output period Pk (the plurality of selection period Ts) and the writing period PWR in one horizontal scanning period H. That is, according to the embodiment, since the mobility compensation period in one horizontal scanning period may be sufficiently ensured compared to an example in which the mobility compensation operation is not performed in the data output period Pk (the plurality of selection period Ts), there is an advantage in that the non-uniform luminance caused by the non-uniformity of the mobility μ of the driving transistor TDR may be sufficiently suppressed.

Furthermore, the potential VS of the source of the driving transistor TDR at the end point of the writing period PWR is set to a value in which the voltage across both terminals of the light emitting element E is lower than the light emission threshold voltage Vth_e1. Therefore, even at the writing period PWR, the light emitting element E becomes a non-light-emission state.

(e) Light Emission Period PDR

Figure 10:
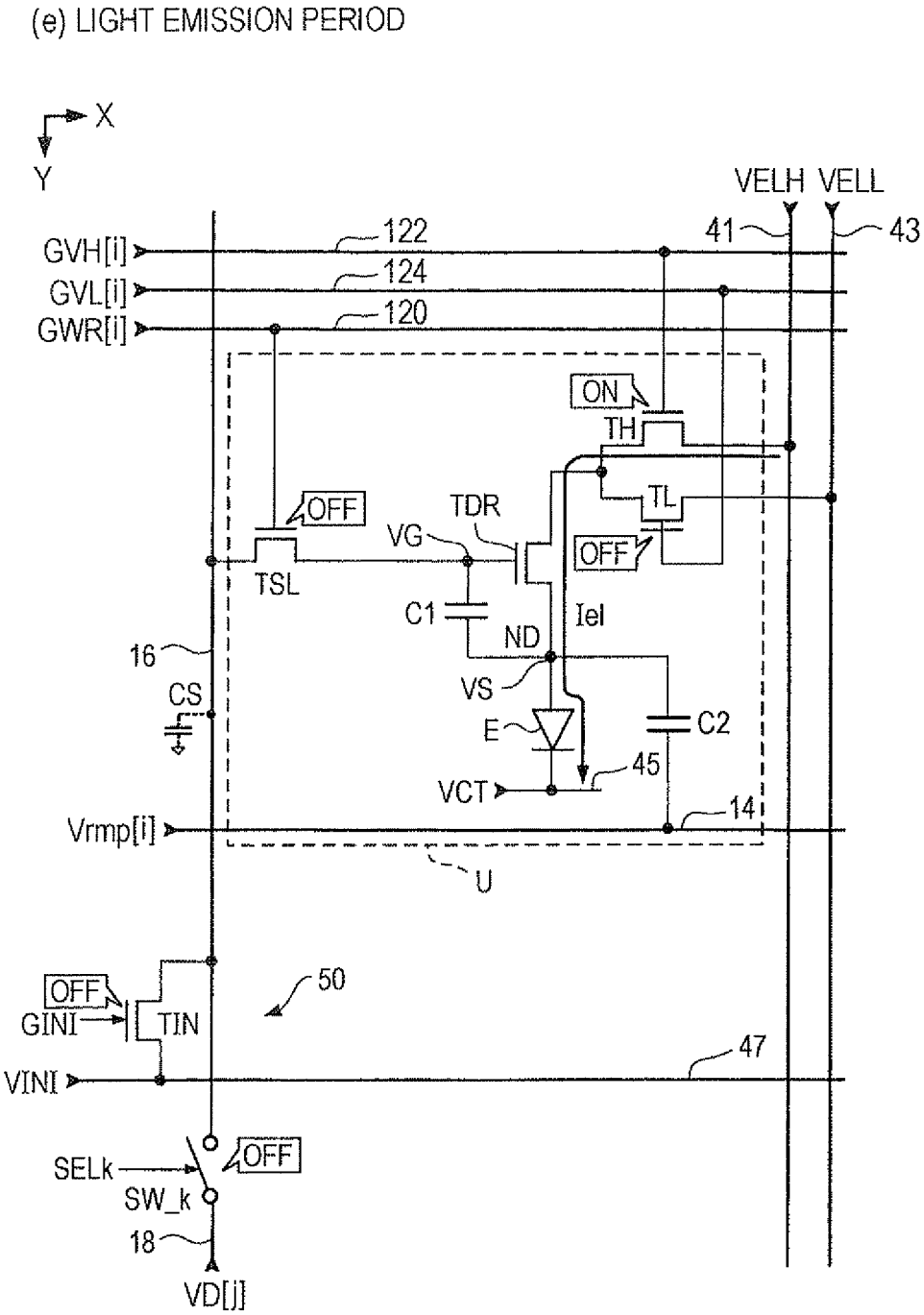
FIG. 10 is a diagram illustrating an operation of the pixel circuit in a light emission period.

As shown in FIG. 4, when the light emission period PDR starts, the driving circuit 20 (the scanning line driving circuit 21) sets the scanning signal GWR[i] to a low level. Therefore, as shown FIG. 10, the selection transistor TSL changes to an off state, and the gate of the driving transistor TDR becomes an electrical floating state. Further, since the driving circuit 20 (the potential generating circuit 25) sets the ramp potential Vrmp[i] output to the i-th ramp power feeding line 14 to the constant reference potential Vref, as understood from the equation (1), the value of the set current Is becomes zero.

At this time, since the voltage (the gate-source voltage of the driving transistor TDR) across both terminals of the first capacitance element C1 is maintained at the voltage VGS2 at the end point of the writing period PWR, the current Ie1 in accordance with the voltage VGS2 flows to the driving transistor TDR, so that the potential VS of the source temporally increases. Since the gate of the driving transistor TDR is in an electrical floating state, the potential VG of the gate of the driving transistor TDR increases while being synchronized with the potential VS of the source. Then, the potential VS of the source of the driving transistor TDR gradually increases while the gate-source voltage of the driving transistor TDR is maintained at the voltage VGS2 set at the end point of the writing period PWR. When the voltage across both terminals of the light emitting element E reaches the light emission threshold voltage Vth_e1, the current Te1 flows to the light emitting element E so as to serve as the driving current. The light emitting element E emits light with luminance in accordance with the driving current Ie1.

Now, when a case is assumed in which the driving transistor TDR is operated in a saturation area, the driving current Te1 is expressed by the following equation (4). "β" indicates a gain coefficient of the driving transistor TDR.

$$Ie1=(\beta/2)(VGS2-VTH)^2 \quad (4)$$

The equation (4) is changed when applying the equation (3) thereto.

$$Te1=(\beta/2)(VTH+Va+\Delta V-VTH)^2=(\beta/2)(Va+\Delta V)^2$$

That is, since the driving current Te1 does not depend on the threshold voltage VTH of the driving transistor TDR, the non-uniform luminance caused by the non-uniformity of the threshold voltage VTH for each pixel circuit U is suppressed.

B: SECOND EMBODIMENT

In the electro-optical device 100 according to the first embodiment, the power supply switching transistors TH and TL are provided at all pixel circuits U. On the contrary, in an electro-optical device 100*a* according to the second embodiment, one transistor TH and one transistor TL are provided for each row.

Figure 11:
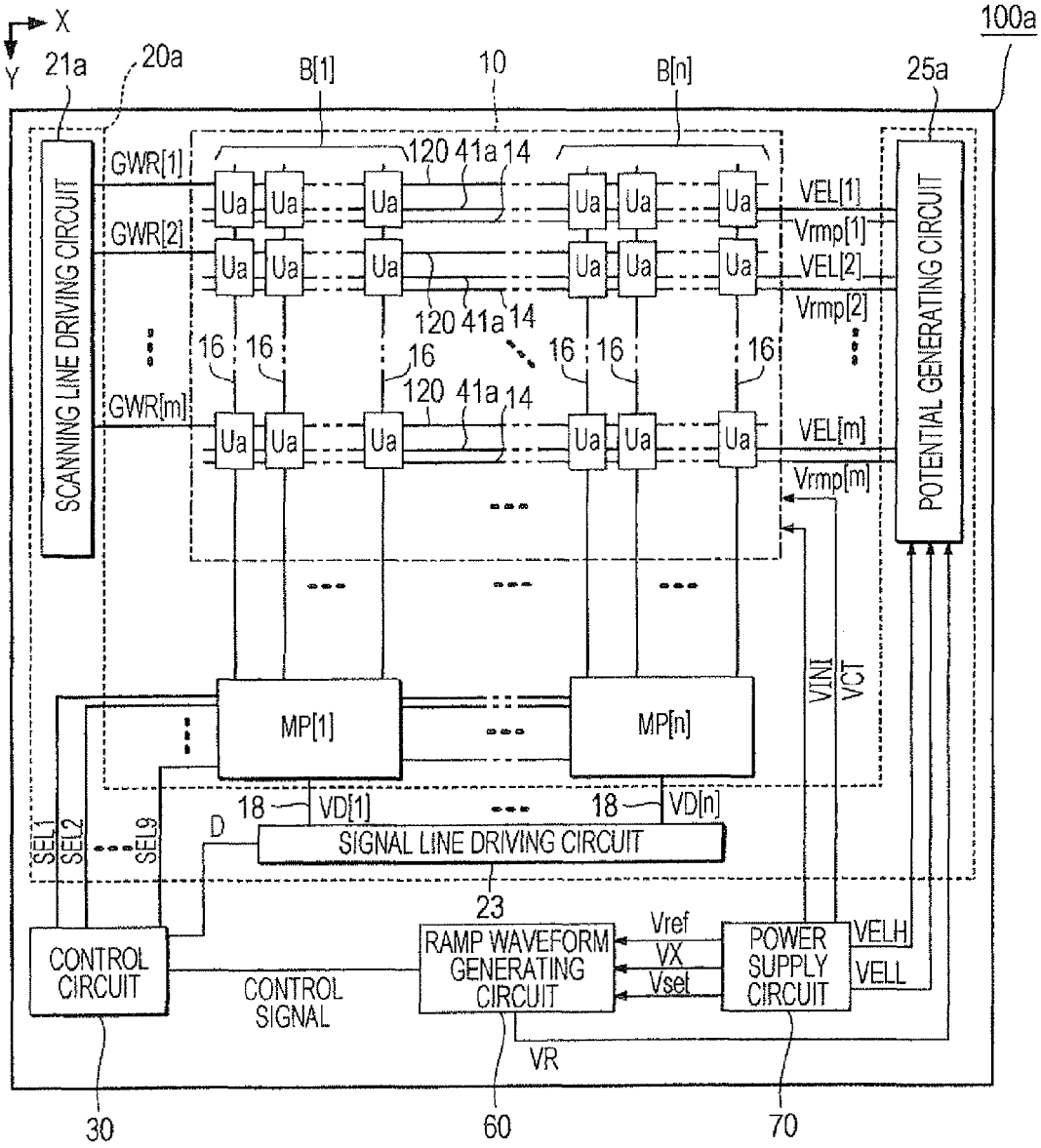
FIG. 11 is a block diagram illustrating an electro-optical device according to a second embodiment of the invention.

FIG. 11 is a block diagram illustrating a configuration of the electro-optical device 100*a* according to the second embodiment. The electro-optical device 100*a* has the same configuration as that of the electro-optical device 100 according to the first embodiment except that a driving circuit 20*a* is provided instead of the driving circuit 20, a power feeding line 41*a* is provided instead of the power feeding line 41 and the power feeding line 43, a pixel circuit Ua is provided instead of the pixel circuit U, a ramp waveform generating circuit 60 is provided, a power supply circuit 70 is provided, and the control line 122 and the control line 124 are not provided.

The driving circuit 20*a* has the same configuration as that of the driving circuit 20 except that a scanning line driving circuit 21*a* is provided instead of the scanning line driving circuit 21 and a potential generating circuit 25*a* is provided instead of the potential generating circuit 25.

In the electro-optical device 100 according to the first embodiment, each of the plurality of pixel circuits U includes the power supply switching transistors TH and TL. On the contrary, in the electro-optical device 100*a*, the potential generating circuit 25*a* includes the power supply switching transistors TH and TL instead of the pixel circuit Ua. That is, in the electro-optical device 100 of the first embodiment, 9n number of transistors TH and TL are provided for each row. However, in the electro-optical device 100*a* of the second embodiment, one transistor TH and one transistor TL are used for each row.

The potential generating circuit 25*a* generates and outputs the potentials VEL[1] to VEL[m] and the ramp potentials Vrmp[1] to Vrmp[m] on the basis of the potential VELH and the potential VELL supplied from the power supply circuit 70, the ramp potential VR supplied from the ramp waveform generating circuit 60, and a control signal (not shown) such as a clock signal supplied from the control circuit 30. The potential generating circuit 25*a* is different from the potential generating circuit 25 in that the potential VCT and the initialization potential VINI are not generated, the potentials VEL[1] to VEL[m] are generated instead of the potential VELH and the potential VELL, and the control signals GVH[1] to GVH [m] and the control signals GVL[1] to GVL[m] are generated inside the potential generating circuit 25*a*.

The scanning line driving circuit 21*a* has the same configuration as that of the scanning line driving circuit 21 except that the control signals GVH[1] to GVH[m] and the control signals GVL[1] to GVL[m] are not generated.

The ramp waveform generating circuit 60 generates the ramp potential VR on the basis of the start potential VX, the reference potential Vref, and the positive potential Vset supplied from the power supply circuit 70 and the control signal such as the clock signal supplied from the control circuit 30. The ramp potential VR is supplied to the potential generating circuit 25*a* via the ramp power feeding line 61.

The power supply circuit 70 generates the start potential VX, the reference potential Vref, the positive potential Vset, the potential VELH, the potential YELL, the potential VCT, and the initialization potential VINI. The start potential VX is supplied to the power feeding line 73, the reference potential Vref is supplied to the power feeding line 74, and the positive potential Vset is supplied to the power feeding line 75. The potential VELH is supplied to the power feeding line 71, and the potential VELL is supplied to the power feeding line 72. The potential VCT is supplied to the power feeding line 45. The initialization potential VINI is supplied to the initialization line 47.

Figure 12:
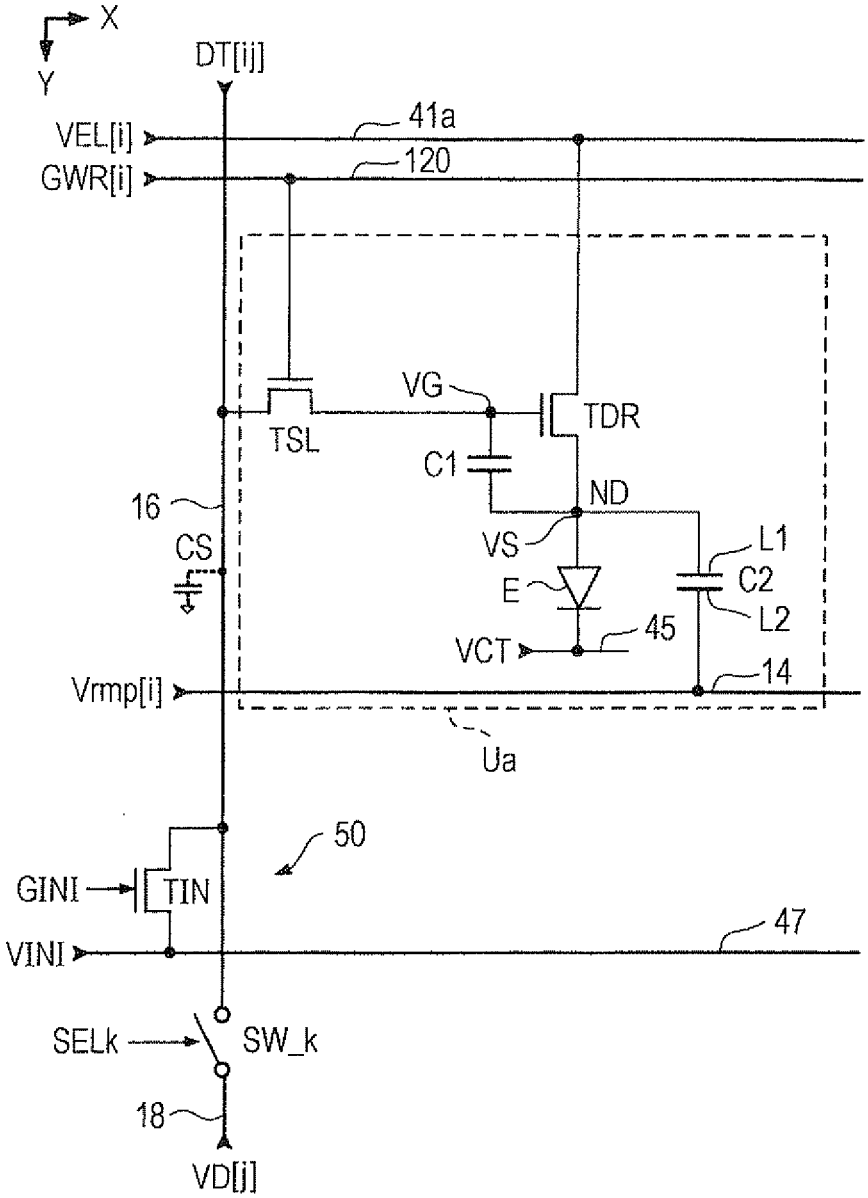
FIG. 12 is a circuit diagram illustrating a pixel circuit according to a second embodiment of the invention.

FIG. 12 is a circuit diagram of the pixel circuit Ua. The pixel circuit Ua has the same configuration as that of the pixel circuit U except that the power supply switching transistors TH and TL are not provided. The drain of the driving transistor TDR is connected to the power feeding line 41*a*.

Figure 13:
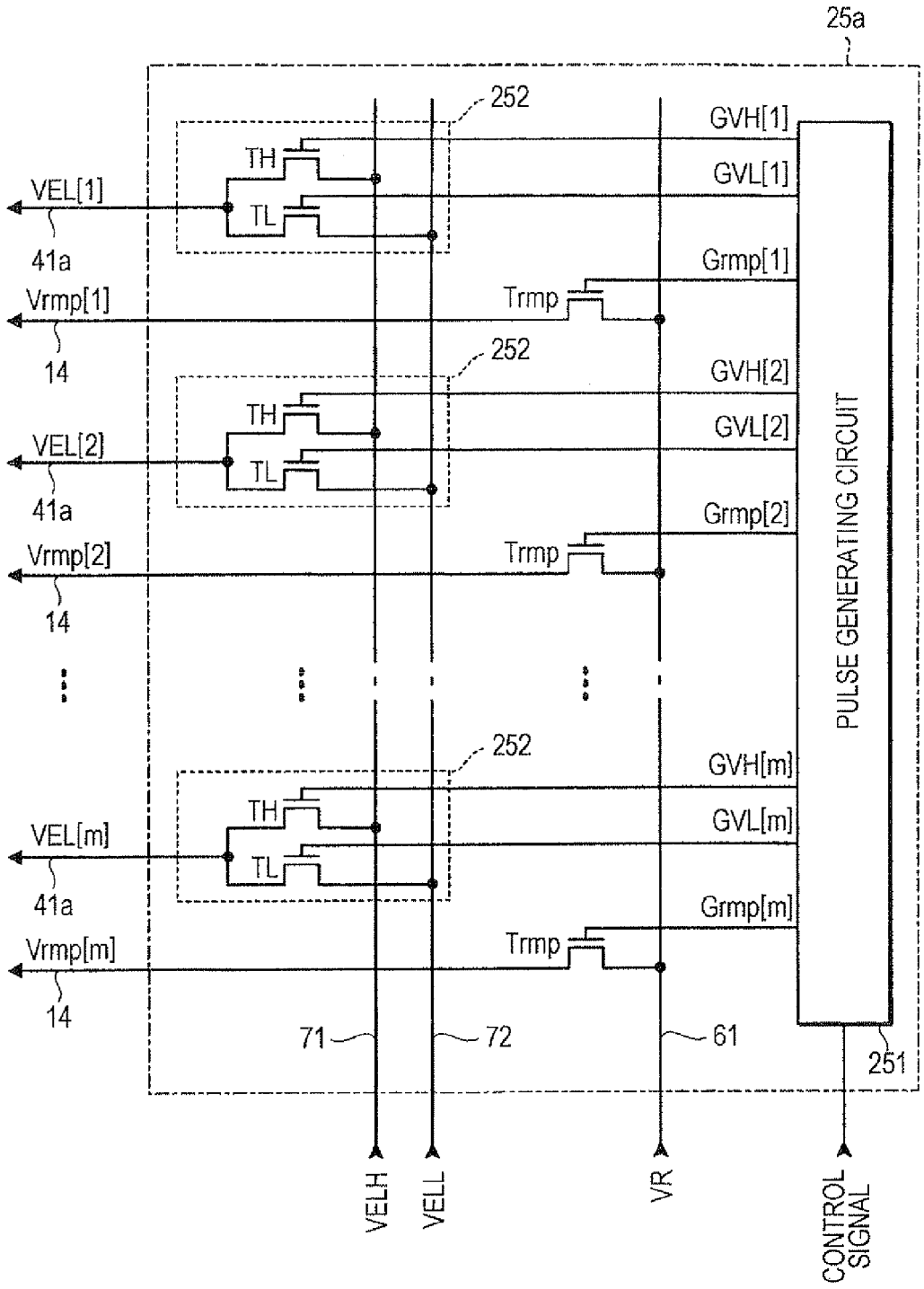
FIG. 13 is a block diagram illustrating a potential generating circuit according to the second embodiment of the invention.

FIG. 13 is a block diagram illustrating a configuration of the potential generating circuit 25*a*. The potential generating circuit 25*a* includes a pulse generating circuit 251, m number of ramp waveform supply transistors Trmp, and m number of potential generating sections 252.

The pulse generating circuit 251 generates the control signals GVH[1] to GVH[m] and the control signals GVL[1] to GVL[m], and outputs the signals to the first to m-th potential generating sections 252.

Further, the pulse generating circuit 251 generates the control signals Grmp[1] to Grmp[m], and outputs the signals to the gates of the first to m-th ramp waveform supply transistors Trmp.

In the embodiment, each ramp waveform supply transistor Trmp is an N-channel-type transistor. The ramp waveform supply transistor Trmp switches the connection and disconnection states between the ramp power feeding line 61 and the ramp power feeding line 14. That is, when i is set to an integer satisfying the i-th ramp waveform supply transistor Trmp becomes an on state when the control signal Grmp[i] supplied to the gate thereof is a high level, so that the ramp power feeding line 61 and the i-th ramp power feeding line 14 are electrically connected to each other. On the other hand, the i-th ramp waveform supply transistor Trmp becomes an off state when the control signal Grmp[i] is a low level, so that the ramp power feeding line 61 and the i-th ramp power feeding line 14 are not electrically connected to each other.

The potential generating section 252 includes power supply switching transistors TH and TL. In the embodiment, each of the transistors TH and TL is an N-channel-type transistor.

The transistor TH switches the connection and disconnection states between the power feeding line 71 and the power feeding line 41*a*. That is, in the i-th potential generating section 252, the transistor TH becomes an on state when the control signal GVH[i] supplied to the gate thereof is a high level, so that the power feeding line 71 and the i-th power feeding line 41*a* are electrically connected to each other. On the other hand, the transistor TH becomes an off state when the control signal GVH[i] is a low level, so that the power feeding line 71 and the i-th power feeding line 41*a* are not electrically connected to each other.

In the same manner, the transistor TL switches the connection and disconnection states between the power feeding line 72 and the power feeding line 41*a*. That is, in the i-th potential generating section 252, the transistor TL becomes an on state when the control signal GVL[i] supplied to the gate thereof is a high level, so that the power feeding line 72 and the i-th power feeding line 41*a* are electrically connected to each other. On the other hand, the transistor TL becomes an off state when the control signal GVL[i] is a low level, so that the power feeding line 72 and the i-th power feeding line 41*a* are not electrically connected to each other.

Furthermore, the transistors TH and TL are operated in a complementary manner. More specifically, the transistor TL becomes an off state when the transistor TH is in an on state, and the transistor TL becomes an on state when the transistor TH is in an off state.

Figure 14:
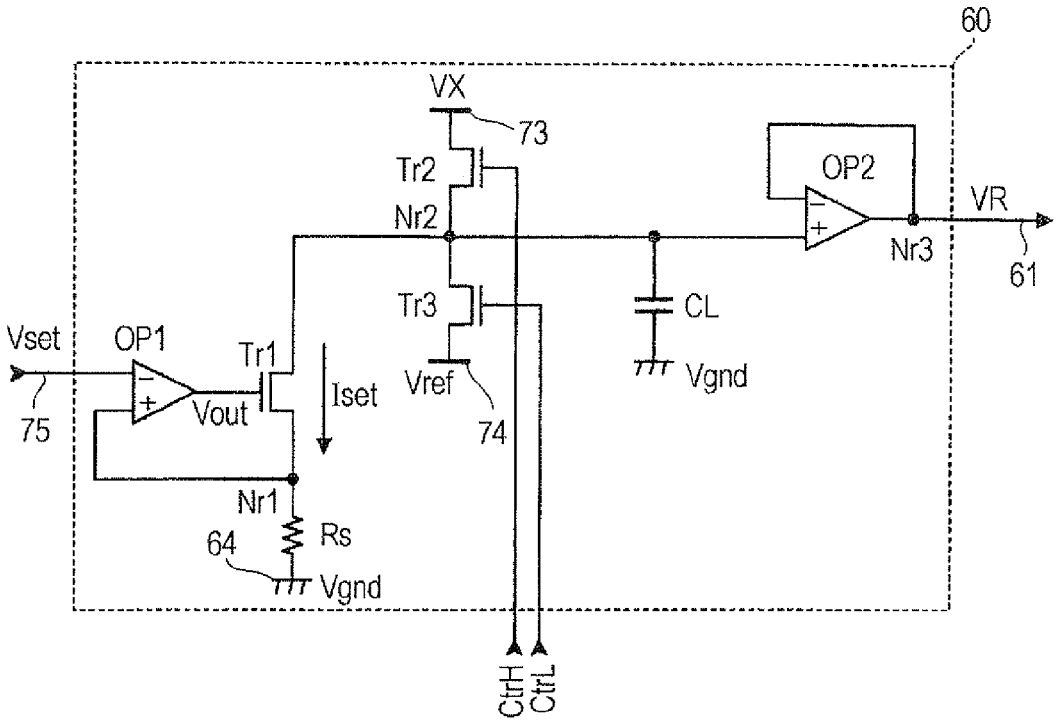
FIG. 14 is a circuit diagram illustrating a ramp waveform generating circuit according to the second embodiment of the invention.

FIG. 14 is a circuit diagram of a ramp waveform generating circuit 60. The ramp waveform generating circuit 60 includes OP-amps OP1 and OP2, N-channel-type transistors Tr1 to Tr3, a capacitance element CL, and a resistor Rs.

The minus input terminal of the OP-amp OP1 is electrically connected to the power feeding line 75 to which the positive potential Vset is supplied, the plus input terminal thereof is electrically connected to the node Nr1, and the output terminal thereof is electrically connected to the gate of the transistor Tr1. The plus input terminal of the OP-amp OP2 is electrically connected to the node Nr2, and the minus input terminal and the output terminal are electrically connected to the node Nr3. Furthermore, the OP-amp OP2 serves as a voltage follower.

The transistor Tr1 is disposed between the node Nr1 and Nr2, and switches the connection and disconnection states therebetween. The transistor Tr2 is disposed between the power feeding line 73 to which the start potential VX is supplied and the node Nr2, and switches the connection and disconnection states on the basis of the control signal CtrH supplied to the gate of the transistor Tr2. The transistor Tr3 is disposed between the power feeding line 74 to which the reference potential Vref is supplied and the node Nr3, and switches the connection and disconnection states therebetween on the basis of the control signal CtrL supplied to the gate of the transistor Tr3.

One electrode of the capacitance element CL is connected to the node Nr2, and the other electrode thereof is connected to the power feeding line to which the ground potential Vgnd is supplied. The resistor Rs has a resistance value Rset, one terminal thereof is connected to the node Nr1, and the other terminal is connected to the power feeding line 64 to which the ground potential Vgnd is supplied.

Figure 15:
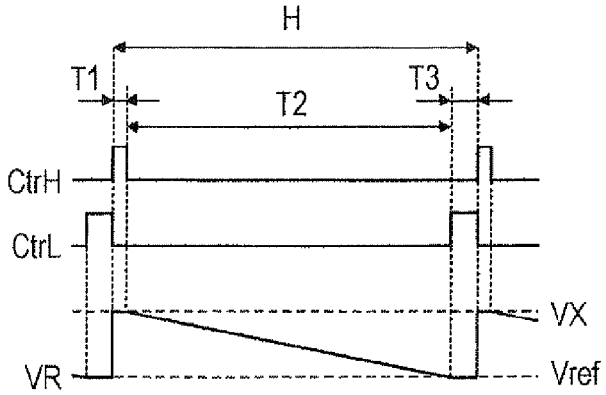
FIG. 15 is a timing chart illustrating an operation of the ramp waveform generating circuit.

FIG. 15 is a timing chart illustrating an operation of the ramp waveform generating circuit 60. In FIG. 15, only one horizontal scanning period H is shown, but the ramp waveform generating circuit 60 is operated in the same manner even in the other horizontal scanning periods H. Each horizontal scanning period H is established by a first period T1, a second period T2, and a third period T3.

The first period T1 is a period which starts at the same time when each horizontal scanning period H starts. In the first period T1, the control signal CtrH becomes a high level and the transistor Tr2 becomes an on state. On the other hand, the control signal CtrL becomes a low level and the transistor Tr3 becomes an off state, so that the potential of the node Nr2 is set to the start potential VX. Accordingly, a charge Q2 is stored in the capacitance element CL.

The second period T2 is a period which starts when ending the first period T1. In the second period T2, the control signal CtrH and the control signal CtrL both become a low level, and the transistors Tr2 and Tr3 become an off state. At this time, the current Iset is generated so as to flow from the capacitance element CL to the power feeding line 64 via the node Nr2, the transistor Tr1, the node Nr1, and the resistance Rs. Here, when the gain of the OP-amp OP1 is denoted by A and the output voltage of the OP-amp OP1 is denoted by Vout, the following equation (5) is established.

$$A\times(Vset-Iset\times Rset)=Vout \quad (5)$$

Here, when A>>Vout, the following equation (6) is established.

$$Vset-Iset\times Rset=Vout/A\approx 0 Iset=Vset/Rset \quad (6)$$

In this manner, in the second period T2, a predetermined magnitude of current Iset flows from the capacitance element CL, and the charge Q2 stored in the capacitance element CL is discharged.

When the capacitance of the capacitance element CL is denoted by Cp2, the following equation (7) is established between the charge Q2 and the potential VNr2 of the node Nr2.

$$Iset=dQ2/dt=Cp2\times d(VNr2)/dt \quad (7)$$

Therefore, by adopting the equations (6) and (7), the temporal change rate RX2 of the potential VNr2 becomes a constant value as shown in the following equation (8).

$$RX2=d(VNr2)/dt=Iset/Cp2=Vset/(Rset\times Cp2) \quad (8)$$

Furthermore, in the embodiment, the temporal change rate RX2 is set to be equal to the reference potential Vref at the end of the second period T2 when the potential VNr2 is equal to the start potential VX at the start of the second period T2.

The third period T3 is a period which starts at the end of the second period T2. In the third period T3, the control signal CtrH becomes a low level and the transistor Tr2 becomes an off state. On the other hand, the control signal CtrL becomes a high level and the transistor Tr3 becomes an on state. Therefore, the potential of the node Nr2 is set to the reference potential Vref.

Furthermore, the potential VNr2 of the node Nr2 is equal to the potential (that is, the ramp potential VR) of the node Nr3. Therefore, the ramp potential VR is set to the start potential VX in the first period T1, linearly decreases at the constant temporal change rate RX2 from the start potential VX to the reference potential Vref in the second period T2, and is set to the reference potential Vref in the third period T3.

Here, the first period T1 and the third period T3 may be set to a sufficiently short period. In this case, the ramp potential VR may be regarded as a potential which linearly decreases from the start potential VX to the reference potential Vref throughout the start point and the end point of one horizontal period.

Figure 16:
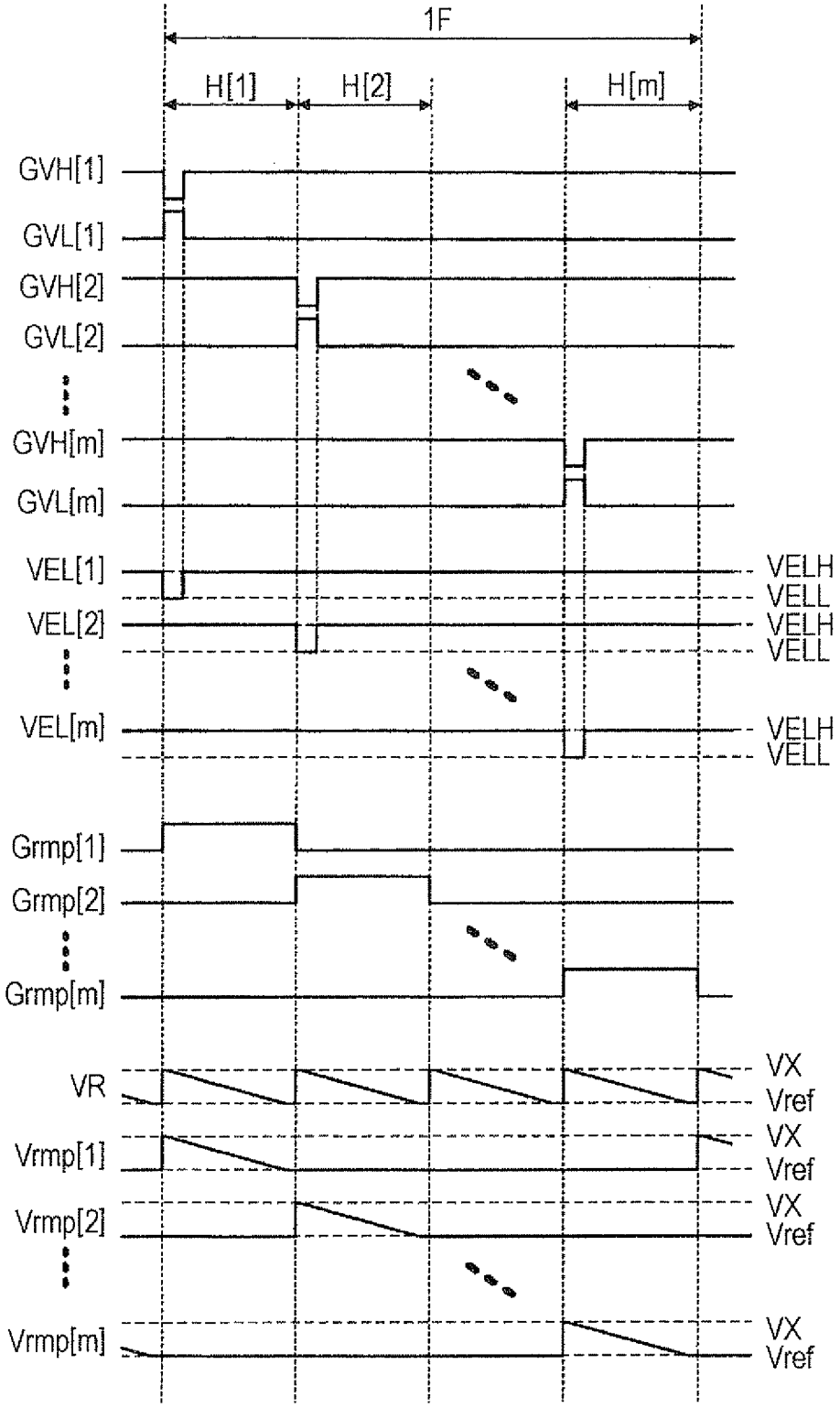
FIG. 16 is a timing chart illustrating an operation of the electro-optical device according to the second embodiment of the invention.

FIG. 16 is a timing chart illustrating an operation of the electro-optical device 100*a*.

As shown in FIG. 16, the control signal GVH[i] generated from the pulse generating circuit 251 is a pulse signal having a cycle of one vertical scanning period F. The pulse signal becomes a low level in the initialization period PRS of the horizontal scanning period H[i] in one vertical scanning period F, and becomes a high level in the other periods. The respective control signals GVH[1] to GVH[m] sequentially fall to a low level by delaying one horizontal scanning period H. In the same manner, the control signal GVL[i] is a pulse signal having a cycle of one vertical scanning period F. The pulse signal becomes a high level in the initialization period PRS of the horizontal scanning period H[i] of one vertical scanning period F, and becomes a low level in the other periods. The respective control signals GVL[1] to GVL[m] sequentially rise to a high level by delaying one horizontal scanning period H.

By using the control signal GVH[i] and the control signal GVL[i], the transistors TH and TL of the i-th potential generating section 252 are controlled to be turned on or off. Since the transistor TH becomes an off state and the transistor TL becomes an on state in the initialization period PRS of the horizontal scanning period H[i], the i-th power feeding line 41*a* and the power feeding line 72 are electrically connected to each other, and the potential VEL[i] is set to the potential VELL. Further, since the transistor TH becomes an on state and the transistor TL becomes an off state in the period other than the initialization period PRS of the horizontal scanning period H[i] in one vertical scanning period F, the i-th power feeding line 41*a* and the power feeding line 71 are electrically connected to each other, and the potential VEL[i] is set to the potential VELH.

In this manner, the potential VEL[i] has a cycle of one vertical scanning period F. The potential is set to the potential VELL in the initialization period PRS of the horizontal scanning period H[i] in one vertical scanning period F, and is set to the potential VELH in the other periods. In the same manner, the potentials VEL[1] to VEL[m] are respectively set to the potential VELL in the initialization periods PRS of the horizontal scanning periods H[1] to H[m], and are set to the potential VELH in the other periods.

The control signal Grmp[i] is a pulse signal having a cycle of one vertical scanning period F. The pulse signal becomes a high level in the horizontal scanning period H[i] of one vertical scanning period F, and becomes a low level in a period other than the horizontal scanning period H[i] of one vertical scanning period F. In the same manner, the control signals Grmp[1] to Grmp[m] are respectively set to a high level in the horizontal scanning periods H[1] to H[m].

The ramp potential VR is set to the start potential VX at the same time when each horizontal scanning period H[i] starts, linearly decreases from the start potential VX to the reference potential Vref at the temporal change rate RX2 in each horizontal scanning period H[i], and is set to the reference potential Vref at the end of each horizontal scanning period H[i].

The i-th ramp waveform supply transistor Trmp is controlled by the control signal Grmp[i] to be turned on or off. Therefore, since the ramp waveform supply transistor Trmp becomes an on state in the horizontal scanning period H[i] at which the control signal Grmp[i] becomes a high level, the i-th ramp power feeding line 14 and the ramp power feeding line 61 are electrically connected to each other, and the ramp potential Vrmp[i] has the same waveform as that of the ramp potential VR. On the other hand, since the control signal Grmp[i] becomes a low level with the end of the horizontal scanning period H[1], the ramp power feeding line 14 and the ramp power feeding line 61 are not electrically connected to each other. The ramp potential VR becomes the reference potential Vref at the end of the horizontal scanning period H[i]. Therefore, the ramp potential Vrmp[i] is set to the reference potential Vref at the end of the horizontal scanning period H[1], and is maintained at the reference potential Vref even after the end of the horizontal scanning period H[i].

In the same manner, the ramp potentials Vrmp[1] to Vrmp[m] are respectively set to the same potential as that of the ramp potential VR in the horizontal scanning periods H[1] to H[m], and are set to the reference potential Vref in the other periods.

In this manner, in the electro-optical device 100*a* according to the second embodiment, the potential generating circuit 25*a* includes the transistors TH and TL corresponding to each power feeding line 41*a* instead that each pixel circuit Ua includes the power supply switching transistors TH and TL.

Therefore, the electro-optical device 100*a* may decrease the size of the pixel circuit Ua. Further, an aperture ratio of the pixel may improve.

Further, the electro-optical device 100*a* has a configuration in which the potential generating circuit 25*a* includes one transistor TH and one transistor TL for each row instead that each pixel circuit Ua includes the transistors TH and TL. When each pixel circuit includes the transistors TH and TL, the transistors TH and TL are needed as many as the number of 2×m×9n in total. On the contrary, in the electro-optical device 100*a*, since the potential generating circuit 25*a* includes the transistors TH and TL for each row, 2×m number of the transistors TH and TL may be provided in total, whereby the number of the transistors may be remarkably decreased.

In this manner, the electro-optical device 100*a* according to the second embodiment has advantages in that a decrease in size and cost of the device may be realized and a high-resolution display may be realized.

Further, the electro-optical device 100*a* has a configuration in which m number of interconnections of the power feeding line 41*a* are provided instead of 4m number of interconnections of the power feeding line 41, the power feeding line 43, the control line 122, and the control line 124 in total. Therefore, the electro-optical device 100*a* according to the second embodiment has advantages in that the number of interconnections may be remarkably decreased, a decrease in size and cost of the device may be realized, and a high-resolution display may be realized.

C: MODIFIED EXAMPLE

The invention is not limited to the above-described embodiments, and for example, the following modifications may be made. Further, two or more modified examples in the following modified examples may be combined with each other.

(1) Modified Example 1

In the above-described embodiments, the driving circuit 20 generates the set current Is by temporally changing the ramp potential Vrmp[i] output to the i-th ramp power feeding line 14 (that is, by temporally changing the charge amount of the second capacitance element C2) in the set period PS, but the invention is not limited thereto. That is, an example may be adopted in which a positive current source generating the set current Is is provided instead of the second capacitance element C2 and the ramp power feeding line 14. In other words, each pixel circuit U may include a current generating section generating the set current Is.

(2) Modified Example 2

In the above-described embodiments, the potential output to the ramp power feeding line 14 linearly changes at the constant temporal change rate RX, but the invention is not limited thereto. That is, the potential output to the ramp power feeding line 14 may arbitrarily change. For example, the waveform of the potential output to the ramp power feeding line 14 may have a curve shape. In other words, the potential output to the ramp power feeding line 14 may temporally change so that the set current Is flows to the driving transistor TDR.

(3) Modified Example 3

In the above-described embodiments, the driving circuit 20 linearly decreases the ramp potential Vrmp[i] output to the ramp power feeding line 14 at the temporal change rate RX in the initialization period PRS, but the invention is not limited thereto. That is, the potential of the ramp power feeding line 14 at the initialization period PRS may be arbitrarily set. For example, in the initialization period PRS, the driving circuit 20 may fix the potential output to the ramp power feeding line 14 to a predetermined magnitude of potential.

(4) Modified Example 4

The light emitting element E may be an OLED element, an inorganic light emitting diode, or an LED (Light Emitting Diode). In brief, any element emitting light in accordance with the supply of the electric energy (the application of the electric field or the supply of the current) may be used as the light emitting element according to the invention.

(5) Modified Example 5

In the above-described embodiments, the power supply switching transistors TH and TL are both configured as an N-channel-type transistor, but any one of the power supply switching transistors TL and TH may be configured as a P-channel-type transistor.

For example, when the power supply switching transistor TL is configured as a P-channel-type transistor, all the power supply switching transistors TH and TL may be controlled to be turned on or off by the control signal GVH[i], and the control signal generated by the pulse generating circuit 251 may be reduced.

(6) Modified Example 6

In the above-described first embodiment, the ramp waveform is generated by the potential generating circuit 25, but the invention is not limited thereto. That is, as in the second embodiment, the waveform may be generated outside the potential generating circuit 25. Further, in the second embodiment, the potentials VEL[1] to VEL[m] are generated by the potential generating circuit 25*a*, but the invention is not limited thereto. That is, the potentials may be generated by the scanning line driving circuit 21*a*.

D: APPLICATION

Figure 17:
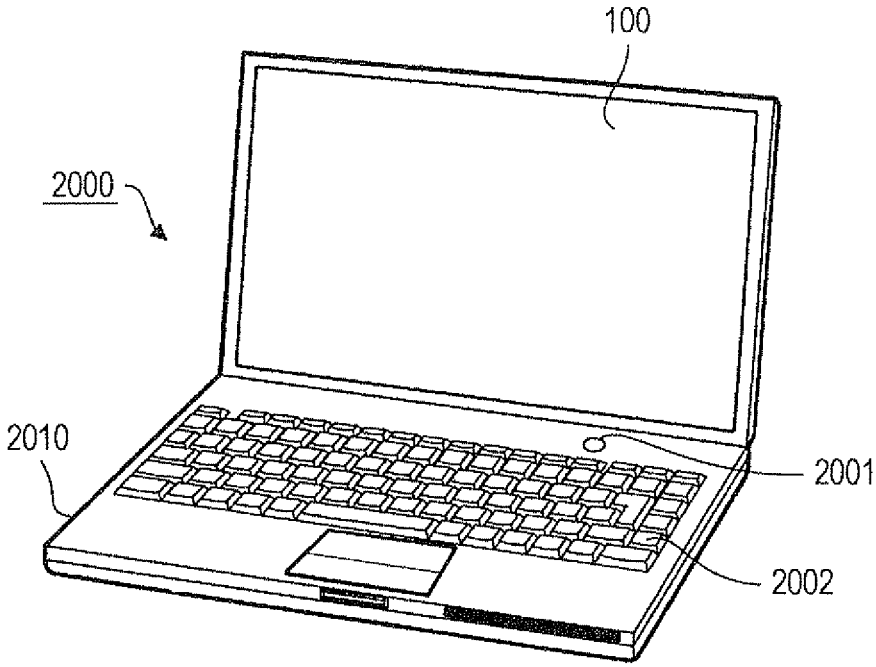
FIG. 17 is a perspective view illustrating a specific example of an electronic apparatus according to the invention.

Next, an electronic apparatus using the light emitting device according to the invention will be described. FIG. 17 is a perspective view illustrating a configuration of a mobile personal computer in which the electro-optical device 100 according to the above-described embodiments is adopted as a display device. A personal computer 2000 includes the electro-optical device 100 serving as a display device and a main body 2010. The main body 2010 is provided with a power switch 2001 and a keyboard 2002. Since the electro-optical device 100 uses an OLED element as the light emitting element E, it is possible to display a screen which has a wide viewing angle and is easily seen.

Figure 18:
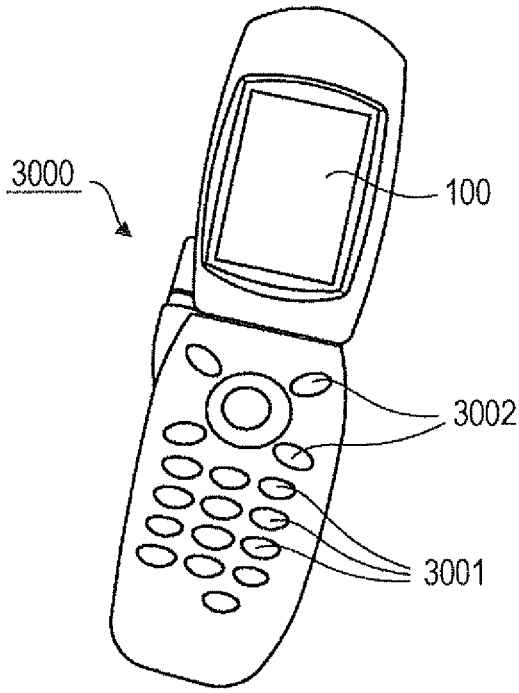
FIG. 18 is a perspective view illustrating a specific example of the electronic apparatus according to the invention.

FIG. 18 illustrates a configuration of a cellular phone in which the electro-optical device 100 according to the above-described embodiments is adopted as a display device. A cellular phone 3000 includes a plurality of manipulation buttons 3001, a scroll button 3002, and the electro-optical device 100. When the scroll button 3002 is manipulated, the screen displayed on the electro-optical device 100 is scrolled.

Figure 19:
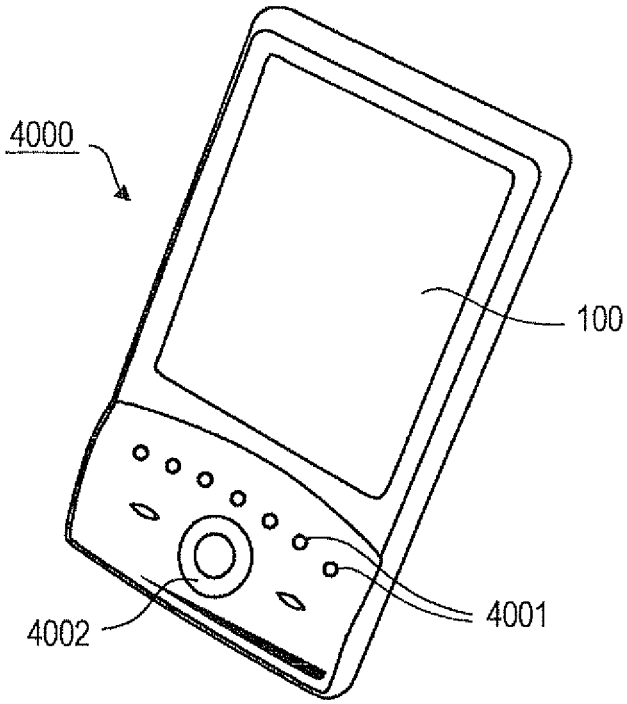
FIG. 19 is a perspective view illustrating a specific example of the electronic apparatus according to the invention.

FIG. 19 illustrates a configuration of a PDA (Personal Digital Assistants) in which the electro-optical device 100 according to the above-described embodiments is adopted as a display device. A PDA 4000 includes a plurality of manipulation buttons 4001, a power switch 4002, and the electro-optical device 100. When the power switch 4002 is manipulated, various information items such as an address list or a schedule note is displayed on the electro-optical device 10.

Furthermore, examples of the electronic apparatus adopting the electro-optical device according to the invention include a digital still camera, a television, a video camera, a car navigation device, a pager, an electronic note, an electronic paper, a computer, a word processor, a workstation, a television phone, a POS terminal, a printer, a scanner, a copying machine, a video player, a device with a touch panel, and the like in addition to the examples shown in FIGS. 17 to 19.

The entire disclosures of Japanese Patent Application No.: 2010-256551, filed Nov. 17, 2010 and No.: 2011-057668, filed Mar. 16, 2011 are expressly incorporated by reference herein.

What is claimed is:

1. An electro-optical device comprising:

a plurality of pixel circuits each of which is disposed so as to correspond to each intersection between a plurality of scanning lines and a plurality of data lines sorted as a plurality of blocks each having data lines;

a plurality of signal lines each of which corresponds one-to-one to the plurality of blocks;

a plurality of selection sections each of which is provided so as to correspond one-to-one to each of the plurality of blocks and which switches a connection and disconnection state between each data line included in the corresponding block and the signal line corresponding to the block; and a driving circuit that drives the plurality of pixel circuits at a cycle of a unit period, wherein each of the plurality of pixel circuits includes:

a selection transistor that writes a data potential of the data line as an on state in the pixel circuit, and a light emitting element that emits light with luminance in accordance with the written data potential, wherein the unit period includes a plurality of selection periods and a writing period after the plurality of selection periods, wherein the driving circuit is operated in the plurality of selection periods such that the data potential in accordance with the luminance of the light emitting element of the pixel circuit corresponding to each intersection between the scanning line to be selected in the unit period and each data line included in the block corresponding to the signal line is sequentially output to each signal line and each selection transistor of the plurality of pixel circuits corresponding to the scanning line to be selected in the unit period is set to an off state, wherein the driving circuit is operated in the writing period such that the respective selection transistors of the plurality of pixel circuits corresponding to the scanning line to be selected in the unit period are set to an on state in a batch, and wherein each of the plurality of selection sections is operated in each of the plurality of selection periods such that the data line corresponding to the pixel circuit to be used to supply the data potential output to the signal line corresponding to the selection section in the corresponding selection period and the data line corresponding to the pixel circuit to be used to supply the data potential output to the signal line in the selection period after the corresponding section period are selected to be electrically connected to the signal line.

2. The electro-optical device according to claim 1, wherein each pixel circuit includes:

a driving transistor that is connected in series to the light emitting element in a path between a high potential side power supply line and a low potential side power supply line, a first capacitance element that is interposed between a gate and a source of the driving transistor, and a current generating section that generates a set current flowing to a path branched from a path reaching the light emitting element from the high potential side power supply line via the driving transistor and a node interposed between the driving transistor and the light emitting element, and wherein the driving circuit is operated in the plurality of selection periods and the writing period such that the voltage across ends of the first capacitance element at the end point of the writing period is set to a value reflecting a characteristic of the driving transistor by controlling the current generating section so that the set current flows to each of the driving transistors of the plurality of pixel circuits corresponding to the scanning line to be selected in the unit period.

3. The electro-optical device according to claim 2, wherein the unit period includes a set period before the plurality of selection periods, and wherein the driving circuit is operated in the set period such that the potential of the gate of the driving transistor is set to an initialization potential by setting the potential of each data line to the initialization potential and setting the respective selection transistors of the plurality of pixel circuits corresponding to the scanning line to be selected in the unit period to an on state in a batch, and the voltage across both terminals of the first capacitance element is set to a value necessary for causing the set current to flow to the driving transistor by controlling the current generating section so that a predetermined magnitude of the set current flows to the driving transistor.

4. The electro-optical device according to claim 3, wherein the current generating section includes a power feeding line and a second capacitance element including a first electrode and a second electrode, wherein the first electrode is connected to the node, and the second electrode is connected to the power feeding line, and wherein the driving circuit temporally changes the potential output to the power feeding line from the start of the set period to the end of the writing period within the unit period.

5. The electro-optical device according to claim 4, wherein the potential output to the power feeding line linearly changes from the start of the set period to the end of the writing period within the unit period.

6. An electro-optical device comprising:

a first pixel circuit which is disposed so as to correspond to each intersection between a scanning line and a first data line;

a second pixel circuit which is disposed so as to correspond to each intersection between a scanning line and a second data line;

a signal line;

a selection section that controls a connection state between the signal line and the first data line, the selection section controlling a connection state between the signal line and the first data line;

a driving circuit that drives the first pixel circuit and a second pixel circuit, wherein the first pixel circuit includes:

a first selection transistor that writes a first data potential of the first data line to the first pixel circuit, and a first light emitting element that emits light with luminance in accordance with the first data potential, wherein the second pixel circuit includes:

a second selection transistor that writes a second data potential of the second data line to the second pixel circuit, and a second light emitting element that emits light with luminance in accordance with the second data potential, wherein the driving circuit is operated in a first selection period such that the first data potential is output to the signal line and the first selection transistor and the second selection transistor is set to an off state, wherein the driving circuit is operated in a second selection period such that the second data potential is output to the signal line and the first selection transistor and the second selection transistor is set to an off state, wherein the driving circuit is operated in a writing period after the first selection period and the second selection period such that the first selection transistor and the second selection transistor are set to an on state, and wherein the selection section is operated such that the first data line and the second data line are electrically connected to the signal line in the first selection period and the second data line is electrically connected to the signal line in the second selection period.

7. An electronic apparatus comprising:

the electro-optical device according to claim 1.

8. An electronic apparatus comprising:

the electro-optical device according to claim 2.

9. An electronic apparatus comprising:

the electro-optical device according to claim 3.

10. An electronic apparatus comprising:

the electro-optical device according to claim 4.

11. An electronic apparatus comprising:

the electro-optical device according to claim 5.

12. An electronic apparatus comprising:

the electro-optical device according to claim 6.

13. A method of driving an electro-optical device at a cycle of a unit period, the electro-optical device including a plurality of pixel circuits each of which is disposed so as to correspond to each intersection between a plurality of scanning lines and a plurality of data lines sorted as a plurality of blocks each having data lines and a plurality of signal lines each of which corresponds one-to-one to the plurality of blocks, each of the plurality of pixel circuits including a selection transistor that writes a data potential of the data line as an on state in the pixel circuit and a light emitting element that emits light with luminance in accordance with the written data potential, wherein the unit period includes a plurality of selection periods and a writing period after the plurality of selection periods, wherein the data potential in accordance with the luminance of the light emitting element of the pixel circuit corresponding to each intersection between the scanning line to be selected in the unit period and each data line included in the block corresponding to the signal line is sequentially output to each signal line, and the data line corresponding to the pixel circuit to be used to supply the data potential output to the signal line corresponding to the selection section in the corresponding selection period and the data line corresponding to the pixel circuit to be used to supply the data potential output to the signal line in the selection period after the corresponding section period are selected to be electrically connected to the signal line in the plurality of selection periods, and wherein the data potential written to the data line corresponding to the pixel circuit is supplied to each of the plurality of pixel circuits corresponding to the scanning line to be selected in the unit period in the writing period.

14. A method of driving an electro-optical device including a first pixel circuit which is disposed so as to correspond to first intersection between a scanning line and a first data line, a second pixel circuit which is disposed so as to correspond to second intersection between a scanning line and a second data line, a signal line, the first pixel circuit including a first selection transistor and a first light emitting element, the second pixel circuit including a second selection transistor and a second light emitting element, the method comprising:

outputting a first data potential to the signal line and connecting electrically the first data line and the second data line to the signal line in a first selection period;

outputting a second data potential to the signal line and connecting electrically the second data line to the signal line in a second selection period;

supplying the first data potential output to the first data line through the first selection transistor to the first pixel circuit and supplying the second data potential output to the second data line through the second selection transistor to the second pixel circuit in a writing period after the first selection period and the second selection period.

* * * * *